US010378292B2

(12) United States Patent
Shahipassand et al.

(10) Patent No.: US 10,378,292 B2
(45) Date of Patent: Aug. 13, 2019

(54) DEVICE TO RESIST ROTATIONAL FORCES WHILE DRILLING A BOREHOLE

(71) Applicant: NABORS LUX FINANCE 2 SARL, Luxembourg (LU)

(72) Inventors: Siamak Shahipassand, Stavanger (NO); Patrick Reiners, Stavenger (NO); Stig Bakke, Algard (NO); Andrew Gorrara, Algard (NO)

(73) Assignee: NABORS LUX 2 SARL, Luxembourg (LU)

( * ) Notice: Subject to any disclaimer, the term of this patent is extended or adjusted under 35 U.S.C. 154(b) by 231 days.

(21) Appl. No.: 15/336,334

(22) Filed: Oct. 27, 2016

(65) Prior Publication Data

US 2017/0122043 A1 May 4, 2017

Related U.S. Application Data

(60) Provisional application No. 62/250,368, filed on Nov. 3, 2015.

(51) Int. Cl.
*E21B 17/10* (2006.01)
*E21B 7/06* (2006.01)

(52) U.S. Cl.
CPC ..... *E21B 17/1078* (2013.01); *E21B 7/062* (2013.01); *E21B 17/1064* (2013.01)

(58) Field of Classification Search
CPC .. E21B 17/10; E21B 17/1014; E21B 17/1057; E21B 17/1078; E21B 17/1064; E21B 7/062; E21B 7/067; E21B 3/00
See application file for complete search history.

(56) References Cited

U.S. PATENT DOCUMENTS 5,582,260 A 12/1996 Murer et al.
5,623,991 A * 4/1997 Jani ..... E21B 23/01 166/216
5,655,609 A 8/1997 Brown et al.
5,941,323 A 8/1999 Warren
5,971,085 A 10/1999 Colebrook
6,062,309 A 5/2000 Gosse
6,073,693 A * 6/2000 Aldridge ..... E21B 23/01 166/217
6,244,361 B1 6/2001 Comeau et al.
6,318,462 B1 11/2001 Tessier
6,629,568 B2 10/2003 Post et al.
6,668,949 B1 12/2003 Rives
6,681,853 B2 1/2004 Doyle et al.
6,761,232 B2 7/2004 Moody et al.
6,968,897 B2 11/2005 Doyle et al.
7,083,010 B2 8/2006 Eppink et al.
7,140,431 B2 11/2006 Betts
7,143,848 B2 12/2006 Armell
(Continued)

*Primary Examiner* — Michael R Wills, III
(74) *Attorney, Agent, or Firm* — Adolph Locklar

(57) ABSTRACT

An antirotation stabilizer may include one or more antirotation pads extending from a stabilizer body. Each antirotation pad may be positioned at least partially within a recess formed in the stabilizer body. Each antirotation pad may be coupled to a torsion bar. The torsion bar may couple between the antirotation pad and the stabilizer body and may be under torsional loading such that the antirotation pad is extended from the stabilizer body. The antirotation stabilizer may include one or more rollers.

18 Claims, 24 Drawing Sheets

(56) References Cited

U.S. PATENT DOCUMENTS

| | | | |
|---|---|---|---|
| 7,188,689 | B2 | 3/2007 | Maxwell et al. |
| 7,204,325 | B2 | 4/2007 | Song et al. |
| 7,243,722 | B2 | 7/2007 | Oosterling et al. |
| 7,252,143 | B2 | 8/2007 | Sellers et al. |
| 7,287,608 | B2 | 10/2007 | Mocivnik et al. |
| 7,306,058 | B2 | 12/2007 | Cargill et al. |
| 7,401,666 | B2 | 7/2008 | Fanuel et al. |
| 7,584,811 | B2 | 9/2009 | Fanuel et al. |
| 7,669,668 | B2 | 3/2010 | Martinez |
| 7,748,447 | B2 | 7/2010 | Moore |
| 7,886,834 | B2 | 2/2011 | Spencer et al. |
| 7,900,708 | B2 | 3/2011 | Obrejanu |
| 8,082,988 | B2 | 12/2011 | Redlinger et al. |
| 8,157,024 | B2 | 4/2012 | de Paula Neves et al. |
| 8,162,076 | B2 | 4/2012 | Martinez et al. |
| 8,474,552 | B2 | 7/2013 | de Paula Neves et al. |
| 8,540,035 | B2 | 9/2013 | Xu et al. |
| 8,714,270 | B2 | 5/2014 | Clemens et al. |
| 8,794,354 | B2 | 8/2014 | Xu et al. |
| 8,851,193 | B1 | 10/2014 | Valerio |
| 8,893,808 | B1 | 11/2014 | Valerio |
| 8,978,782 | B2 | 3/2015 | Martinez et al. |
| 2002/0144815 | A1 | 10/2002 | Van Drentham-Susman et al. |
| 2003/0042022 | A1 | 3/2003 | Lauritzen et al. |
| 2005/0098353 | A1* | 5/2005 | Maxwell ..... E21B 17/1014 175/57 |
| 2006/0157283 | A1 | 7/2006 | Hart |
| 2009/0114448 | A1 | 5/2009 | Laird et al. |
| 2009/0229424 | A1* | 9/2009 | Montgomery ..... E21B 19/07 81/57.15 |
| 2012/0061099 | A1 | 3/2012 | Wold et al. |
| 2014/0060812 | A1* | 3/2014 | Young ..... E21B 23/06 166/118 |
| 2014/0262216 | A1 | 9/2014 | Perry |
| 2014/0262343 | A1 | 9/2014 | Larsen et al. |
| 2014/0338976 | A1 | 11/2014 | Xu et al. |
| 2015/0000987 | A1 | 1/2015 | Xu et al. |
| 2015/0144327 | A1 | 5/2015 | Millet |
| 2015/0233182 | A1* | 8/2015 | Forstner ..... E21B 47/0002 175/45 |

* cited by examiner

DEVICE TO RESIST ROTATIONAL FORCES WHILE DRILLING A BOREHOLE

CROSS-REFERENCE TO RELATED APPLICATIONS

This application is a nonprovisional application which claims priority from U.S. provisional application No. 62/250,368, filed Nov. 3, 2015.

TECHNICAL FIELD/FIELD OF THE DISCLOSURE

The present disclosure relates to downhole drilling tools, and specifically to stabilizers for and non-rotating sections of downhole drilling tools.

BACKGROUND OF THE DISCLOSURE

When drilling a directional wellbore, a variety of technologies are used to steer the drilling string. In many of these technologies, the bottomhole assembly (BHA) may include a substantially non-rotating sub (hereinafter "non-rotating sub") surrounding a rotating drill shaft. The non-rotating sub is typically coupled to the rotating drill shaft by one or more bearings, and uses the surrounding wellbore to maintain its orientation. However, due to the torsional forces exerted thereupon by the rotating drill shaft, some undesirable rotation of the non-rotating sub may occur.

SUMMARY

The present disclosure provides for an antirotation stabilizer positionable in a wellbore. The antirotation stabilizer may include a stabilizer body having a recess formed therein. The antirotation stabilizer may further include an antirotation pad positioned at least partially within the recess. The antirotation stabilizer may further include a torsion bar coupled between the stabilizer body and the antirotation pad. The torsion bar may be coupled to the antirotation pad off center of the antirotation pad and may be in torsional loading.

The present disclosure also provides for an antirotation stabilizer positionable in a wellbore. The antirotation stabilizer may include a stabilizer body having a recess formed therein. The antirotation stabilizer may also include an antirotation roller coupled to the stabilizer body and positioned at least partially within the recess. The antirotation roller may be biased outward into contact with the wellbore.

The present disclosure also provides for a method. The method may include providing an antirotation stabilizer. The antirotation stabilizer may include a stabilizer body having a recess formed therein. The antirotation stabilizer may include an antirotation pad positioned at least partially within the recess. The antirotation stabilizer may include a torsion bar coupled between the stabilizer body and the antirotation pad. The torsion bar may be coupled to the antirotation pad off center of the antirotation pad and may be in torsional loading. The method may further include positioning the antirotation stabilizer in an uncased portion of a wellbore, extending the antirotation pad from the stabilizer body under torsion from the torsion bar; engaging the wellbore with the antirotation pad; and preventing rotation of the antirotation stabilizer relative to the wellbore.

The present disclosure also provides for a method. The method may include providing an antirotation stabilizer. The antirotation stabilizer may include a stabilizer body having a recess formed therein. The antirotation stabilizer may also include an antirotation roller coupled to the stabilizer body and positioned at least partially within the recess. The antirotation roller may be biased outward into contact with the wellbore. The method may further include positioning the antirotation stabilizer in an uncased portion of a wellbore, extending the antirotation pad from the stabilizer body under torsion from the torsion bar; engaging the wellbore with the antirotation pad; and preventing rotation of the antirotation stabilizer relative to the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
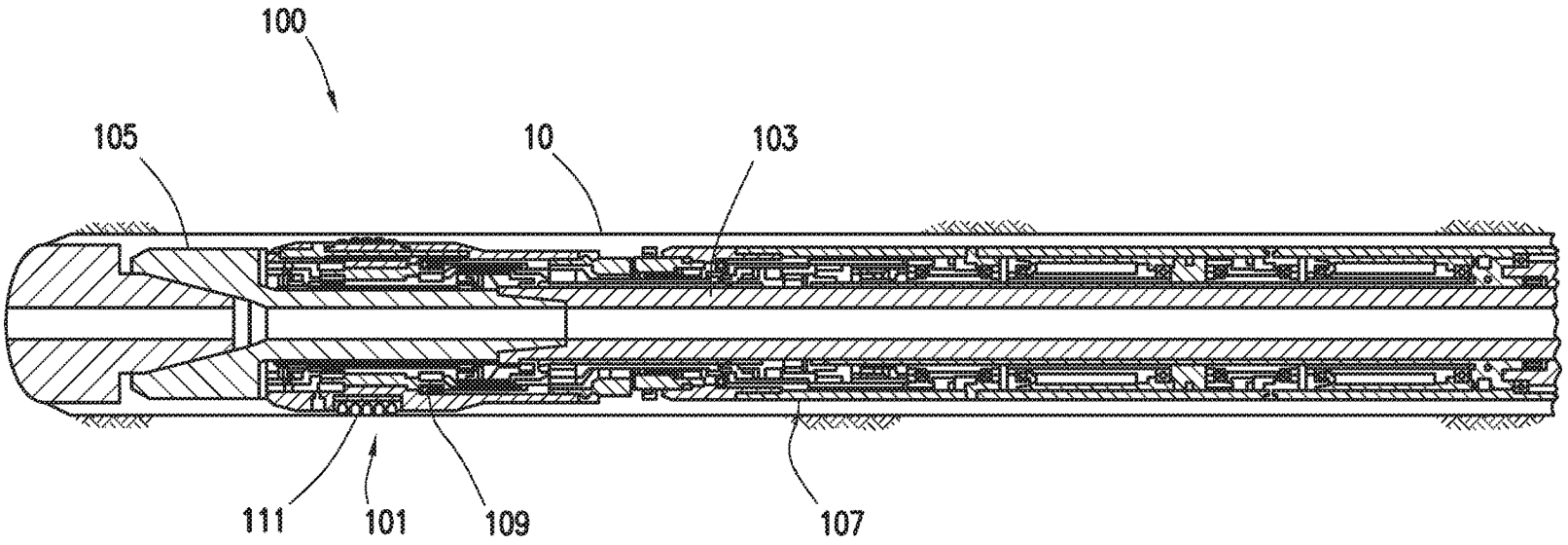
FIG. 1 depicts a cross section of a downhole tool including an antirotation stabilizer consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts bottomhole assembly (BHA) 100 having antirotation stabilizer 101. Although described herein as a stabilizer, one having ordinary skill in the art with the benefit of this disclosure will understand that antirotation stabilizer 101 as described herein may be used with downhole equipment not intended to be limited to freestanding stabilizers and may include, for example, a non-rotating housing, non-rotating stabilizer, or any other tool in contact with the wellbore. BHA 100 may be positioned in wellbore 10. BHA 100 may include a rotating drill shaft 103 coupled to bit box 105 which may receive a drill bit. Drill shaft 103 may be rotated by, for example and without limitation, a mud motor (not shown) or the rotation of the drill string by a drilling rig (not shown).

Antirotation stabilizer 101 may be coupled to non-rotating sub 107. Non-rotating sub 107 may, as understood in the art, include one or more sensors or steering assemblies for steering the drilling of wellbore 10. In some embodiments, BHA 100 may be part of a rotary-steerable system (RSS). As understood in the art, non-rotating sub 107 may slowly rotate relative to wellbore 10. Antirotation stabilizer 101 may contact wellbore 10 as described herein to retard this unintentional rotation of non-rotating sub 107. Antirotation stabilizer 101 and non-rotating sub 107 may be coupled to drill shaft 103 by one or more bearing assemblies.

Antirotation stabilizer 101 may include stabilizer body 109 and one or more antirotation pads 111. Antirotation pads 111 may extend from stabilizer body 109 into contact with the surrounding wellbore 10. Antirotation pads 111 may be extendable blades. In some embodiments, antirotation pads 111 may be constructed of metal. Antirotation pads 111 may be positioned such that torsional forces on antirotation stabilizer 101 are transferred into the surrounding wellbore 10, reducing rotation of antirotation stabilizer 101 and non-rotating sub 107. In some embodiments, antirotation stabilizer 101 may be used in an open hole, i.e. in an uncased portion of wellbore 10. Antirotation pads 111 may be adapted to engage the earthen surface of wellbore 10. As described herein below, antirotation pads 111 may extend far enough from the outer surface of stabilizer body 109 to engage the earthen surface of wellbore 10.

In some embodiments, antirotation pads 111 may be hingedly coupled to stabilizer body 109. In some embodiments, antirotation pads 111 may be extended from stabilizer body 109 by a spring.

Figure 2:
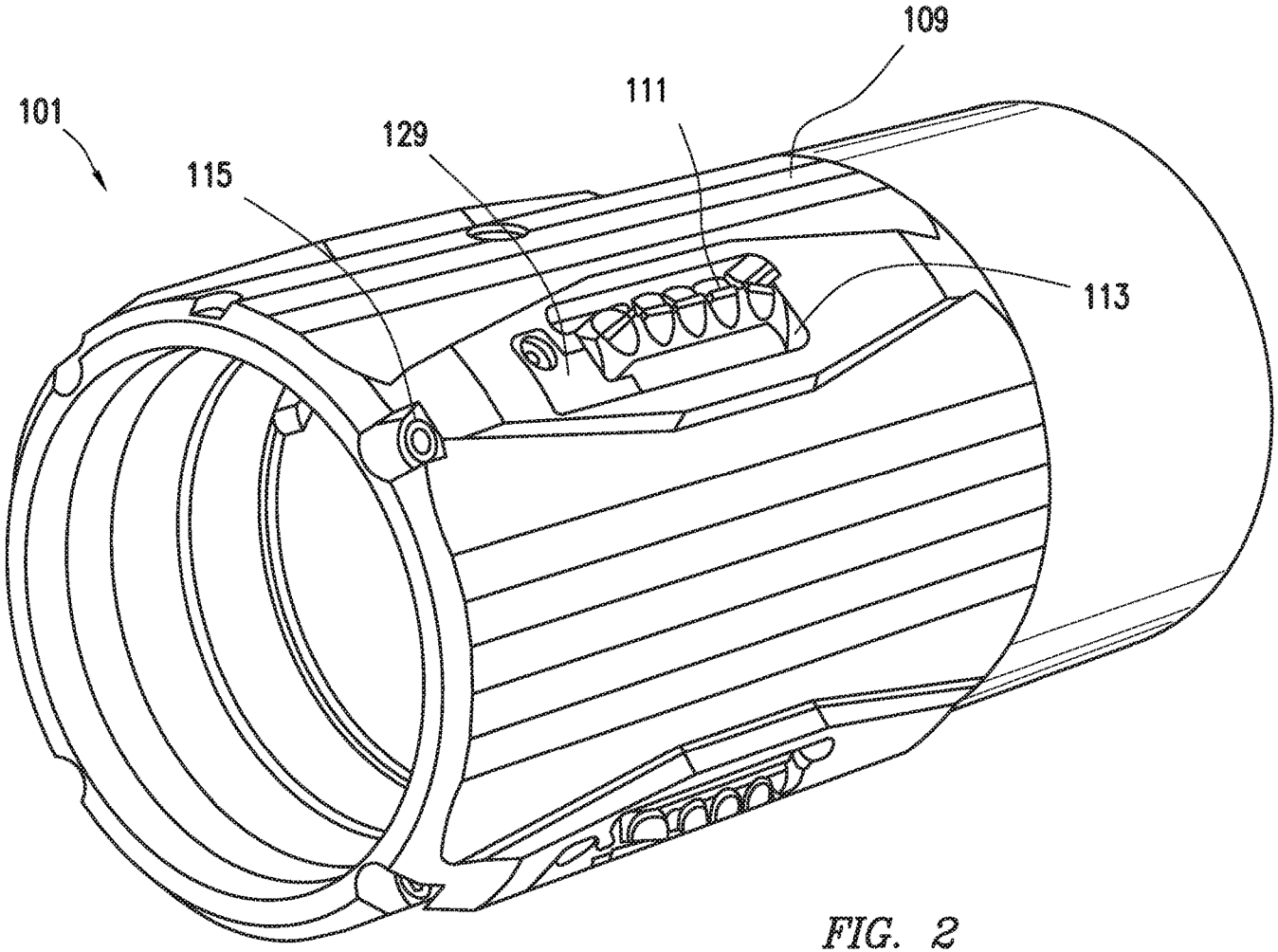
FIG. 2 depicts a perspective view of an antirotation stabilizer consistent with at least one embodiment of the present disclosure.
Figure 3:
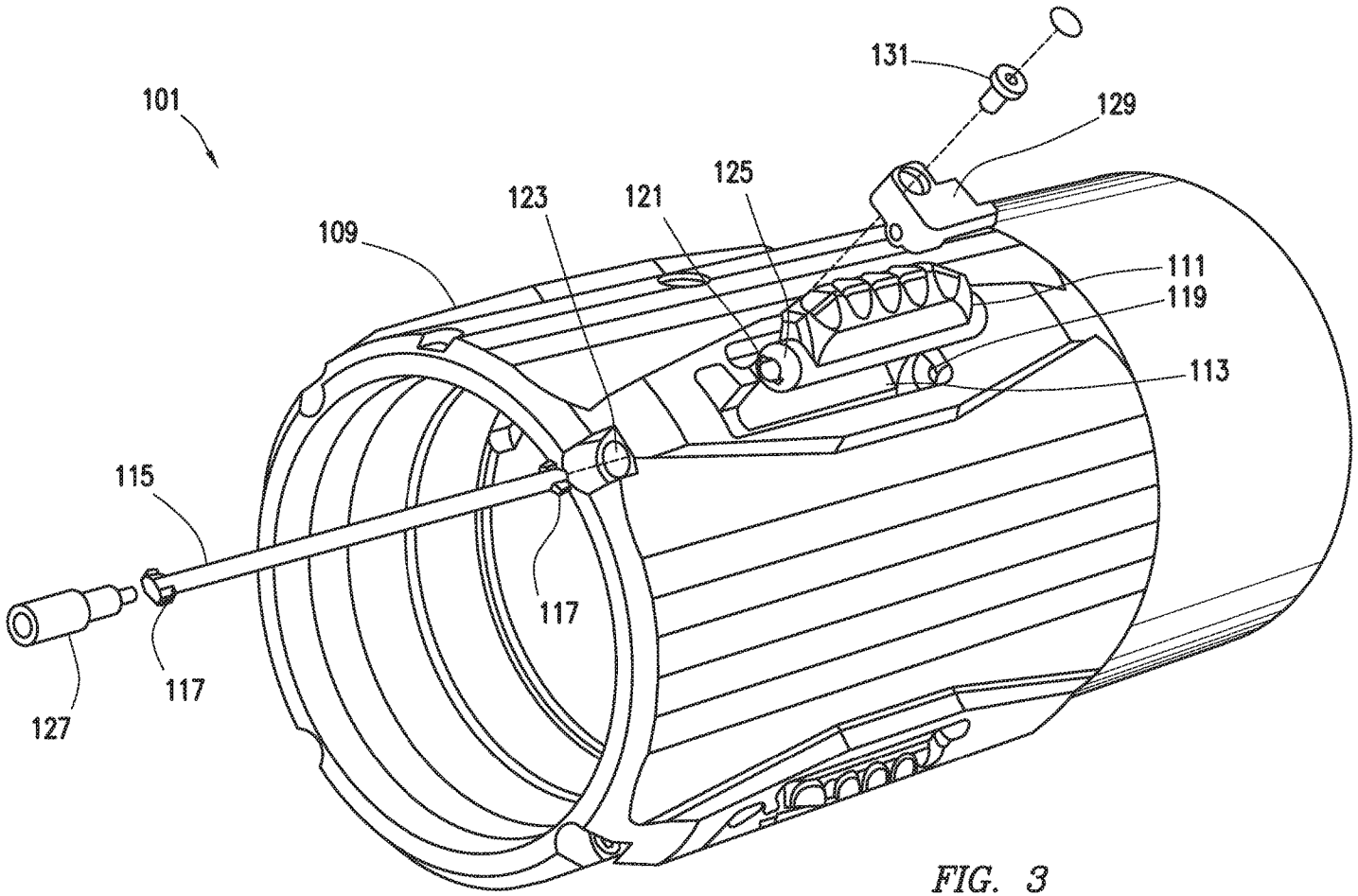
FIG. 3 depicts an exploded view of the antirotation stabilizer of FIG. 2.
Figure 5:
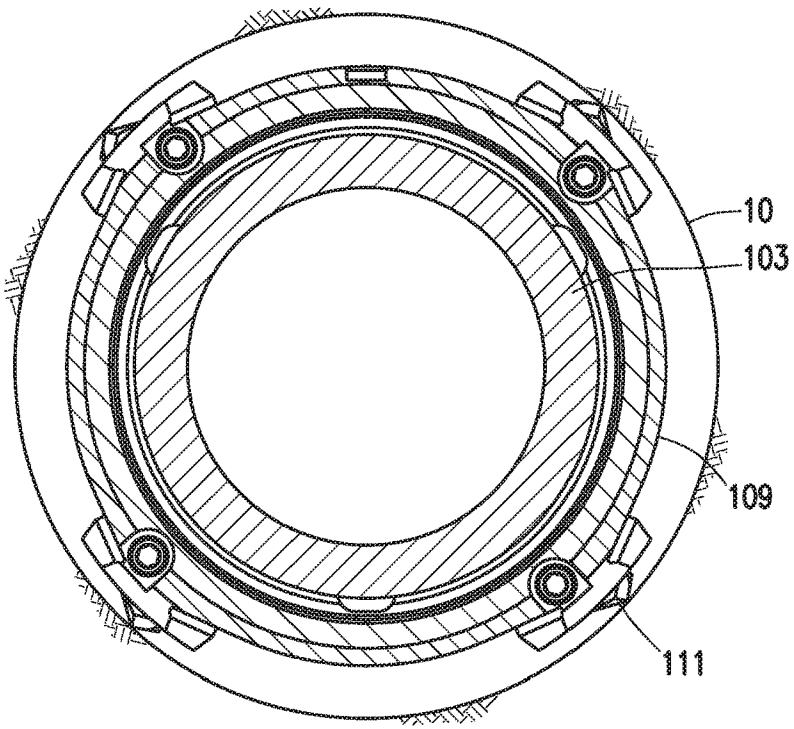
FIG. 5 depicts an end view of the antirotation stabilizer of FIG. 2 with antirotation pads in an extended position.
Figure 4:
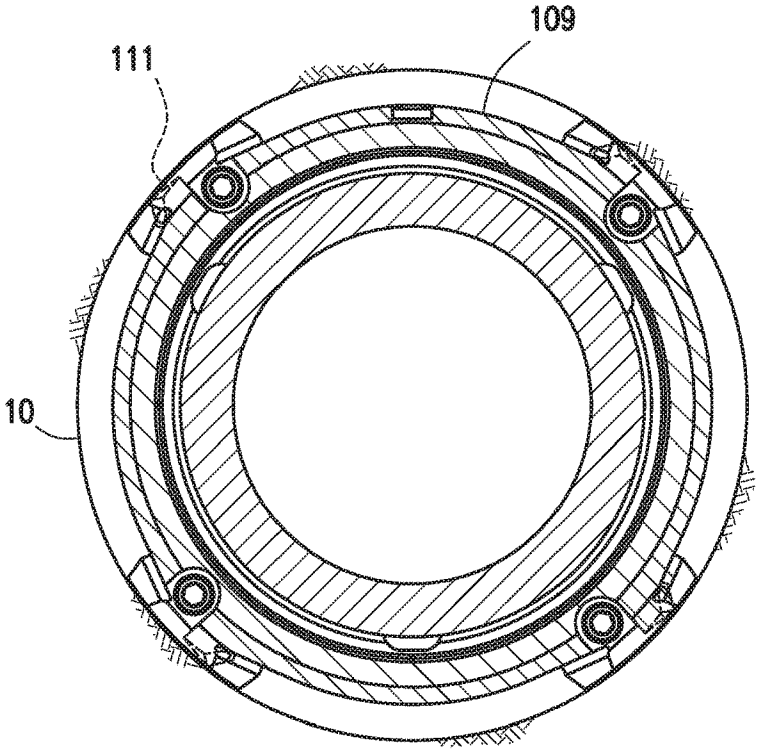
FIG. 4 depicts an end view of the antirotation stabilizer of FIG. 2 with antirotation pads in a retracted position.

In some embodiments, as depicted in FIGS. 2, 3, antirotation pads 111 may be positioned within recesses 113 formed in stabilizer body 109. Antirotation pads 111 may be coupled to stabilizer body 109 in some embodiments by torsion bar 115. Torsion bar 115 may be fixedly coupled at one end to stabilizer body 109 and at the other end to antirotation pads 111. Torsion bar 115 may be coupled to antirotation pads 111 off center such that antirotation pads 111 cam out of recesses 113 when rotated as depicted in FIGS. 4, 5. Torsion bar 115 may be under torsional loading such that antirotation pads 111 are extended from recesses 113 into contact with the surrounding wellbore 10. Antirotation pads 111 may contact wellbore 10 at a contact surface with spring pressure such that antirotation pads 111 extend and retract in response to encountering variations in diameter of wellbore 10.

In some embodiments, antirotation pads 111 may extend such that the extending edge of antirotation pads 111 are ahead of torsion bar 115 in the direction of rotation of drill shaft 103 as previously discussed (counter-clockwise as depicted in FIG. 5), such that torsional forces on antirotation stabilizer 101 cause antirotation pads 111 to further engage wellbore 10. In some embodiments, counter rotation of antirotation stabilizer 101 may cause the retraction of or reduction of grip of antirotation pads 111 on wellbore 10, allowing some rotation of antirotation stabilizer 101 if drill shaft 103 is rotated in the opposite direction. In some embodiments, antirotation pads 111 may be retractable within recesses 113 such that antirotation pads 111 are flush with the outer surface of stabilizer body 109, as depicted in FIG. 4, such as, for example and without limitation, during insertion of antirotation stabilizer 101 through a narrow portion of wellbore 10 or through a section of casing.

In some embodiments, torsion bar 115 may include one or more torque transfer features. In some embodiments, as depicted in FIG. 3, torsion bar 115 may include one or more tabs 117 which couple to slots 119 formed on stabilizer body 109 and pad slots 121 formed on antirotation pads 111 to allow transfer of torsional forces between stabilizer body 109 and antirotation pads 111. In some embodiments, at least a portion of torsion bar 115 may have a geometry which allows transfer of torsional forces between stabilizer body 109 and antirotation pads 111. For example, in some embodiments, not shown, torsion bar 115 may have a rectangular or square cross sectional profile which engages with mating surfaces in stabilizer body 109 and antirotation pads 111 to provide the transfer of torsional loading. In some embodiments, in order to assemble antirotation stabilizer 101, antirotation pad 111 may be inserted into recess 113. Torsion bar 115 may be inserted through body torsion hole 123 and through pad torsion hole 125 such that tabs 117 engage slots 119, 121. Antirotation pad 111 may be in a fully extended position while torsion bar 115 is inserted thereinto. Torsion bar 115 may be retained within body torsion hole 123 by retaining screw 127 or any other suitable retention mechanism known in the art. In some embodiments, antirotation pad 111 may be retained within recess 113 by cover lock 129, which may be held to stabilizer body 109 by one or more screws 131 or any other suitable retention mechanism known in the art. In some embodiments, antirotation pad 111 may be at least partially pressed into recess 113 as cover lock 129 is installed, causing antirotation pad 111 to be under spring tension from the torsionally loaded torsion bar 115 when in the most extended position allowed by cover lock 129.

In some embodiments, antirotation pad 111 may be formed from a single piece of material. In some embodiments, antirotation pad 111 may be formed from a metal such as steel. In some embodiments, antirotation pad 111 may be hardened.

Figure 6:
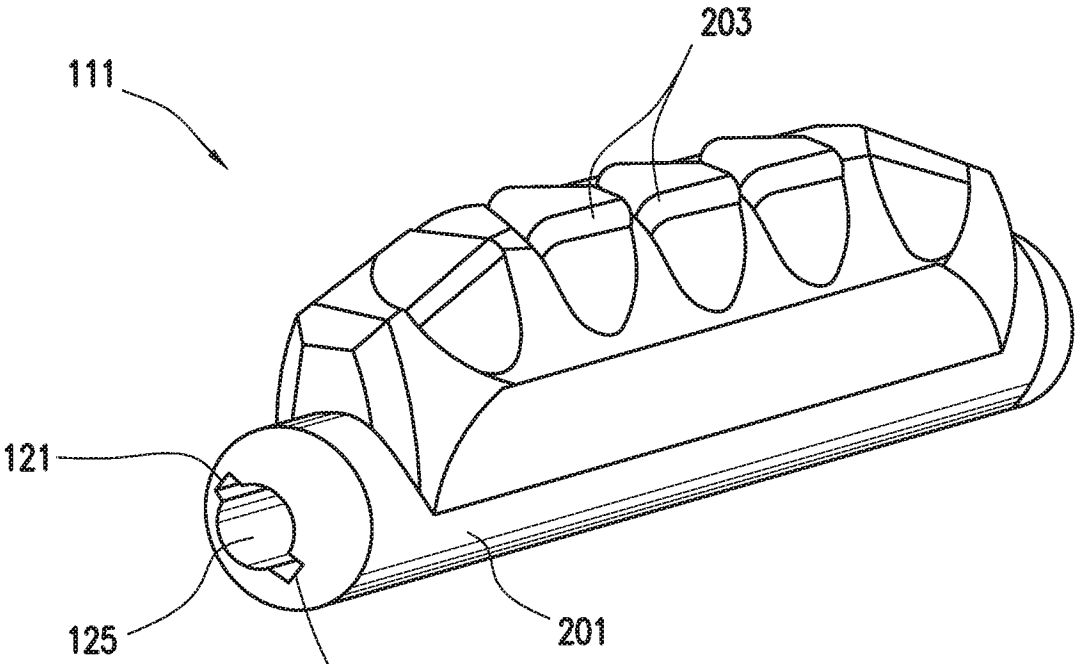
FIG. 6 depicts a perspective view of an antirotation pad of the antirotation stabilizer of FIG. 2.

In some embodiments, as depicted in FIG. 6, antirotation pad 111 may include pad body 201. Pad torsion hole 125 and pad slots 121 as previously discussed may be formed in pad body 201. In some embodiments, pad body 201 may include one or more features to reduce wear of antirotation pad 111. For example, in some embodiments, pad body 201 may include a hard facing. In some embodiments, the hard facing may be, for example and without limitation, tungsten carbide or other alloy may be coupled thereto by welding or laser cladding. In some embodiments, antirotation pad 111 may include one or more inserts positioned on pad body 201 at the intersection between antirotation pad 111 and wellbore 10 as previously discussed. Inserts, discussed further herein below, formed from a hardened material such as, for example and without limitation, tungsten carbide, polycrystalline diamond, or other materials.

The geometry of antirotation pad body 201 and inserts 203 may vary. As depicted in FIG. 6, in some embodiments, one or more triangular inserts 203 may be coupled to pad body 201. Triangular inserts 203 may be shaped to create a small contact area between triangular inserts 203 and wellbore 10 (not shown), thus potentially increasing the force transfer capability therebetween.

Figure 7:
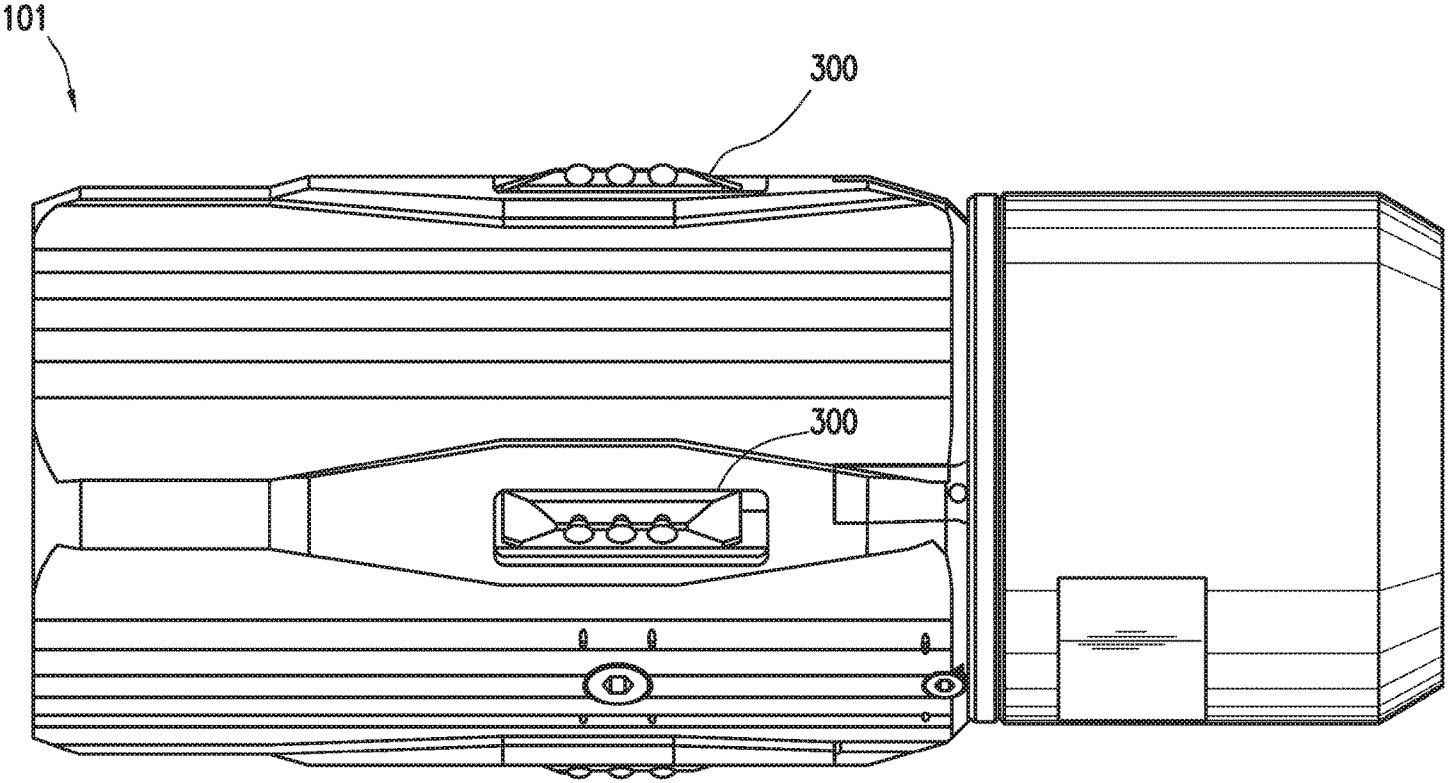
FIG. 7 depicts an elevation view of an antirotation stabilizer consistent with at least one embodiment of the present disclosure.
Figure 8:
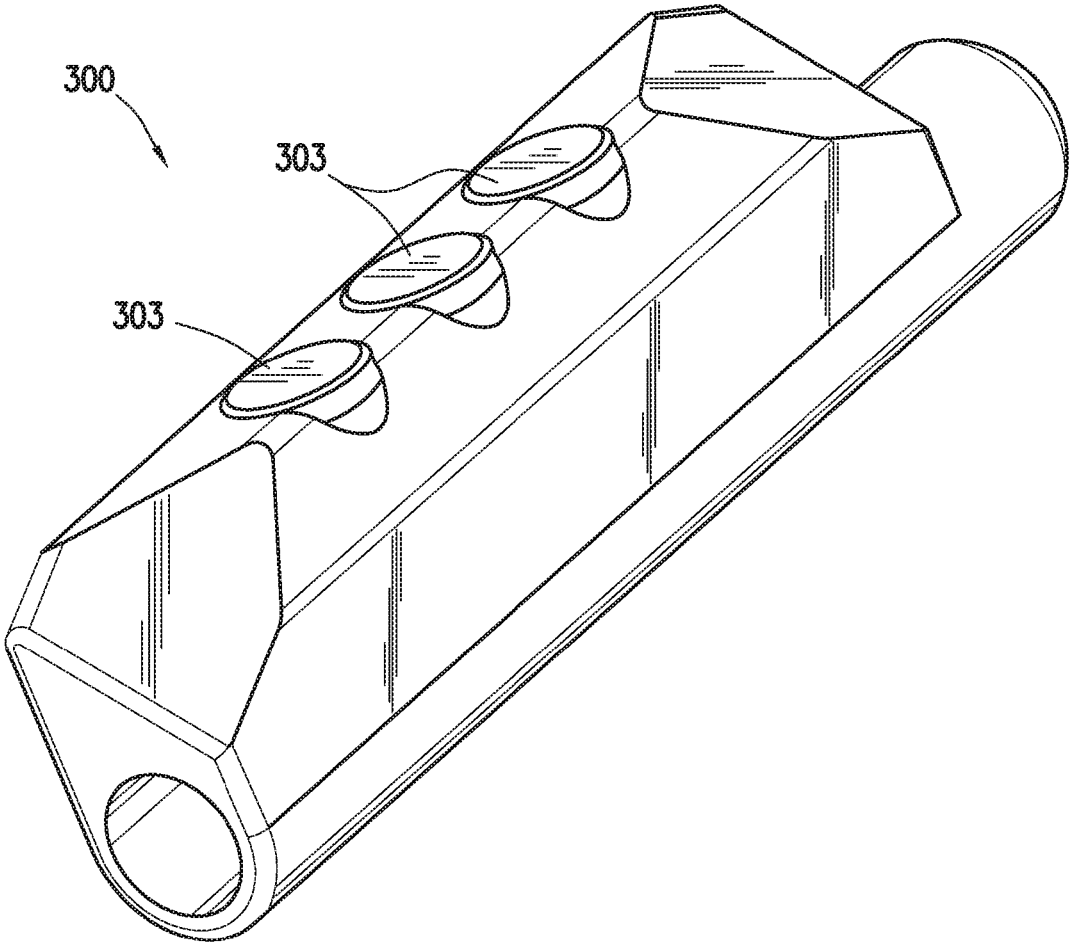
FIG. 8 depicts a perspective detail view of the antirotation pad of FIG. 7.

In some embodiments, as depicted in FIGS. 7, 8, antirotation stabilizer 101 may include antirotation pads 300 having round inserts 303. One having ordinary skill in the art with the benefit of this disclosure will understand that the number of inserts may be varied without deviating from the scope of this disclosure.

Figure 9:
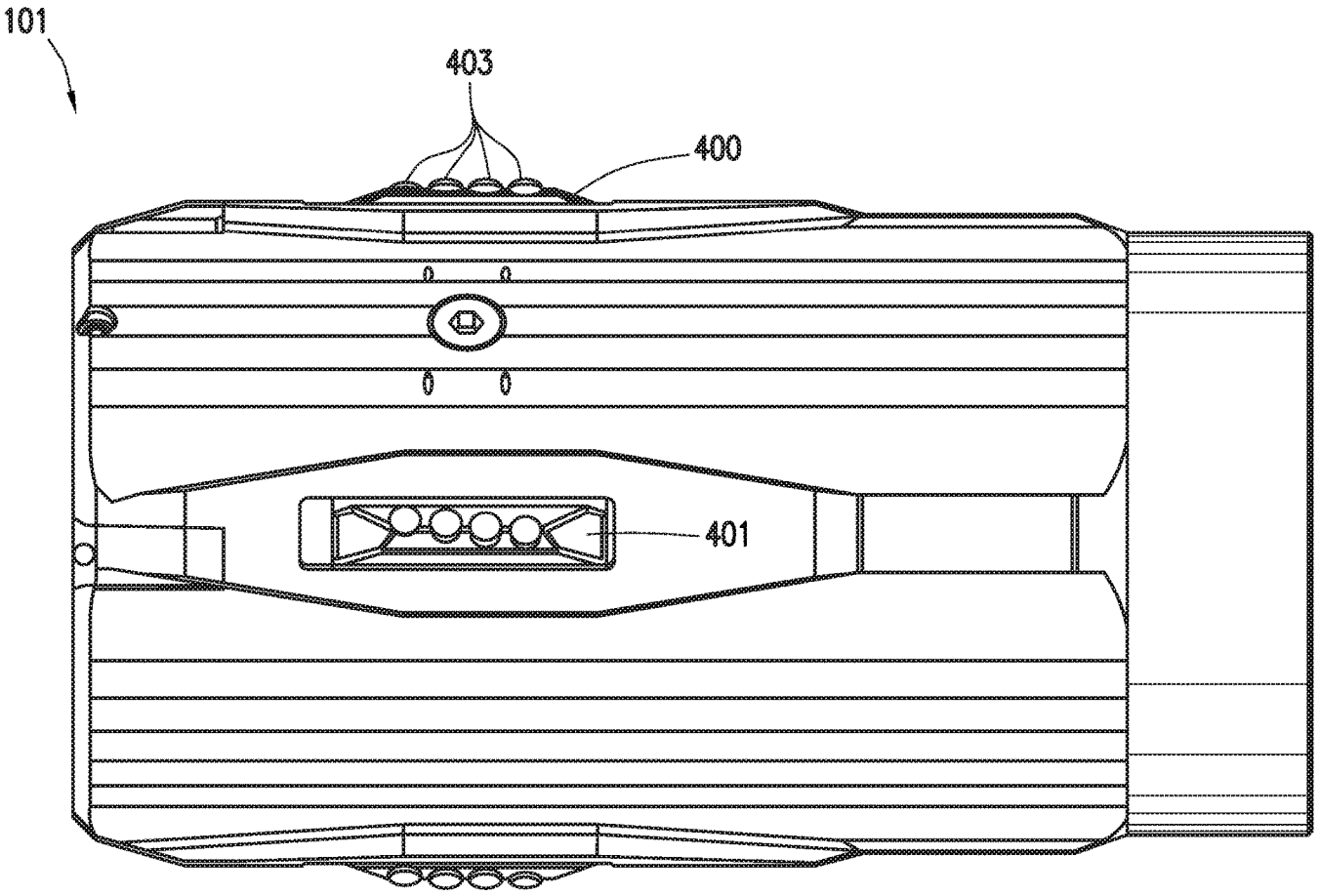
FIG. 9 depicts an elevation view of an antirotation stabilizer consistent with at least one embodiment of the present disclosure.
Figure 10:
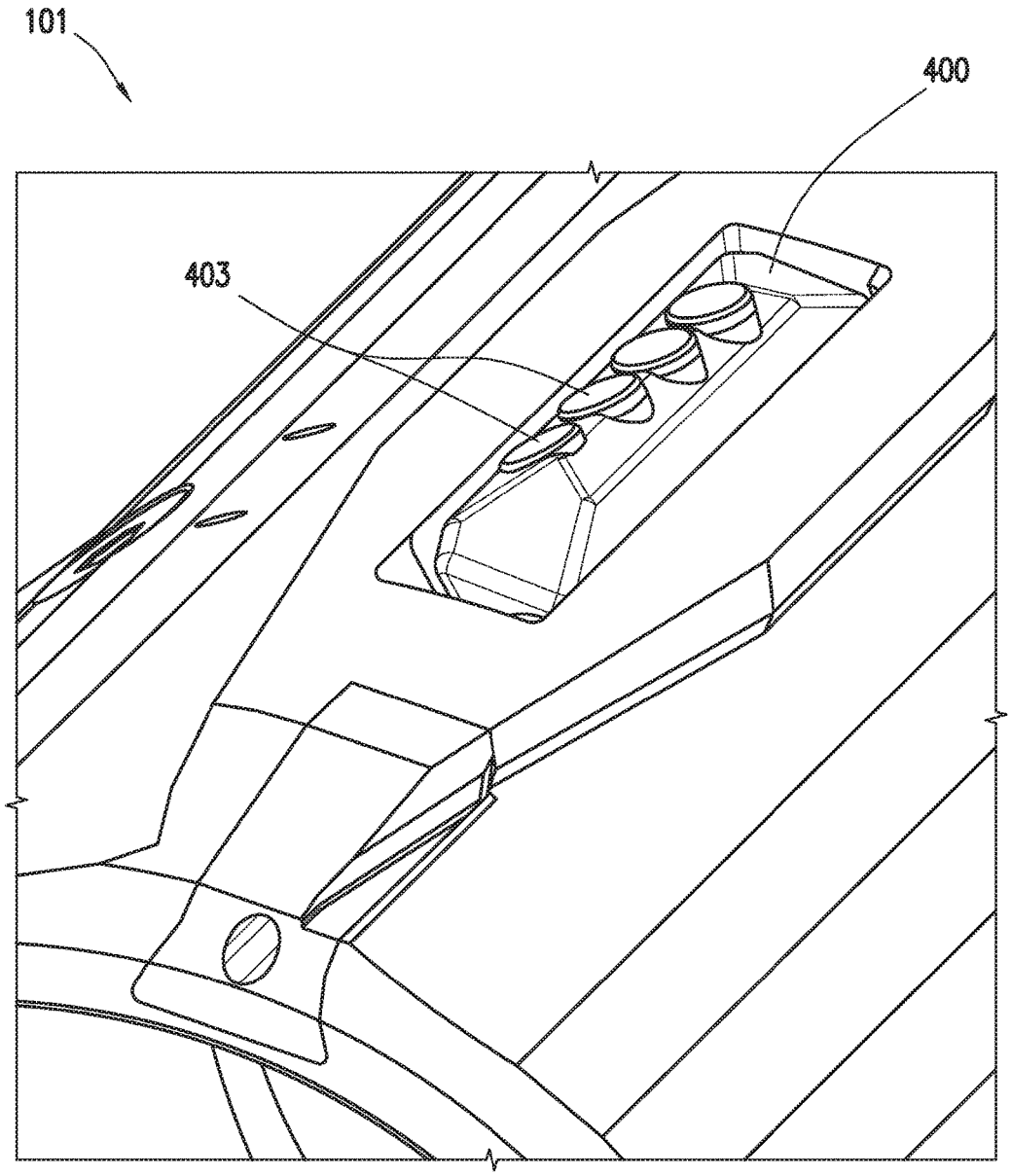
FIG. 10 depicts a perspective detail view of the antirotation stabilizer of FIG. 9.

In some embodiments, as depicted in FIGS. 9-10, antirotation pads 400 may include inserts 403 positioned at varying pitches along pad bodies 401. In some embodiments, as depicted in FIGS. 9, 10, inserts 403 may be positioned such that they are aligned with a helix extending in the direction of rotation of the drilling shaft 103 discussed previously. In such an arrangement, inserts 403 may be aligned such that a portion of at least one of inserts 403 is in contact with wellbore 10 (not shown) during a substantial portion of the traverse of antirotation pads 400.

Figure 11:
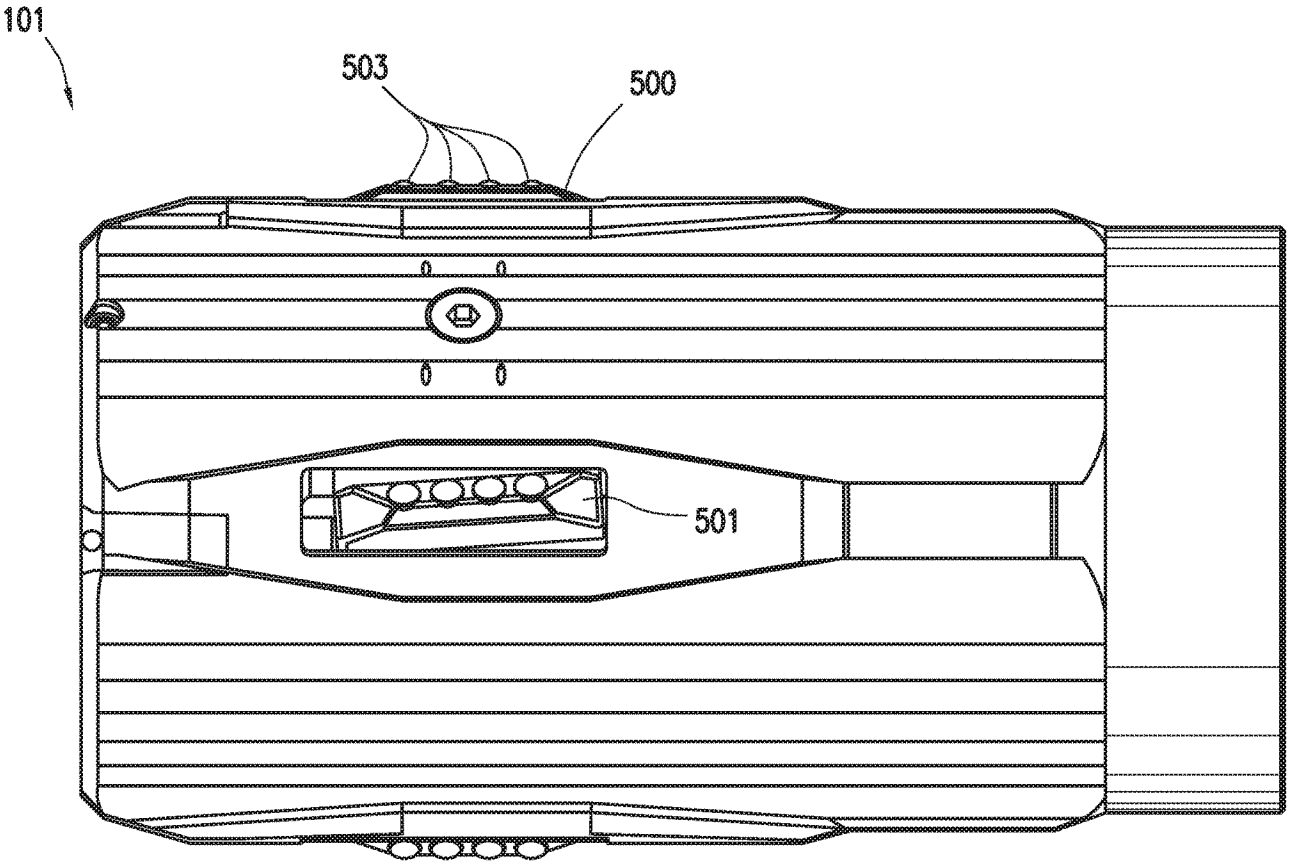
FIG. 11 depicts an elevation view of an antirotation stabilizer consistent with at least one embodiment of the present disclosure.
Figure 12:
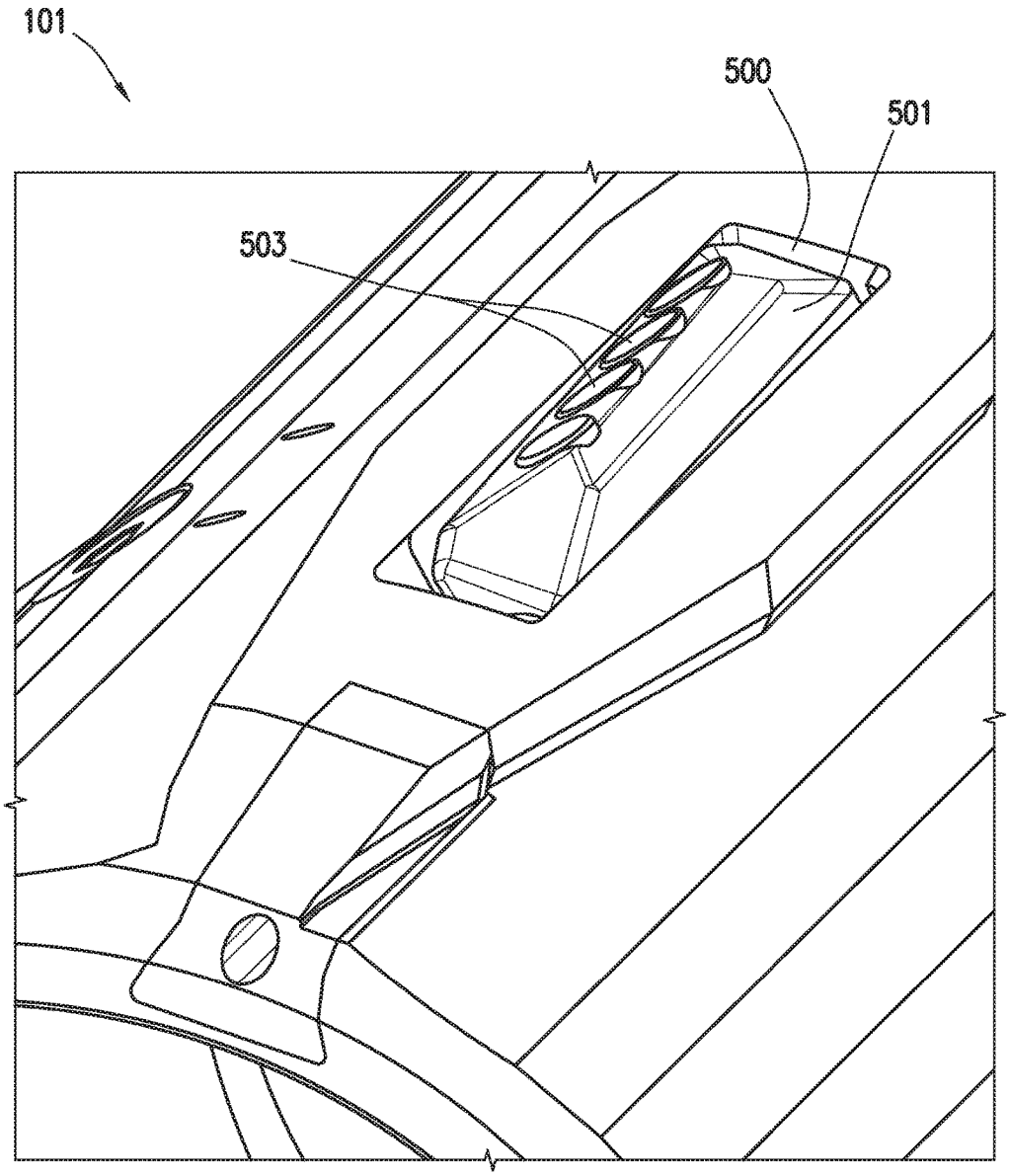
FIG. 12 depicts a perspective detail view of the antirotation stabilizer of FIG. 11.

In some embodiments, as depicted in FIGS. 11-12, antirotation pads 500 may include inserts 503 positioned at varying pitches along pad bodies 501 such that they are aligned with a helix extending in the opposite direction of rotation of the drilling shaft 103 discussed previously. In such an arrangement, inserts 503 may be aligned such that a portion of at least one of inserts 503 is in contact with wellbore 10 (not shown) during a substantial portion of the traverse of antirotation pads 500. Additionally, in such an arrangement, as antirotation stabilizer 101 traverses wellbore 10 (not shown), inserts 503 may, for example and without limitation, induce rotation of antirotation stabilizer 101 to, for example and without limitation, counteract incidental and unintentional rotation thereof during the drilling operation.

Figure 13:
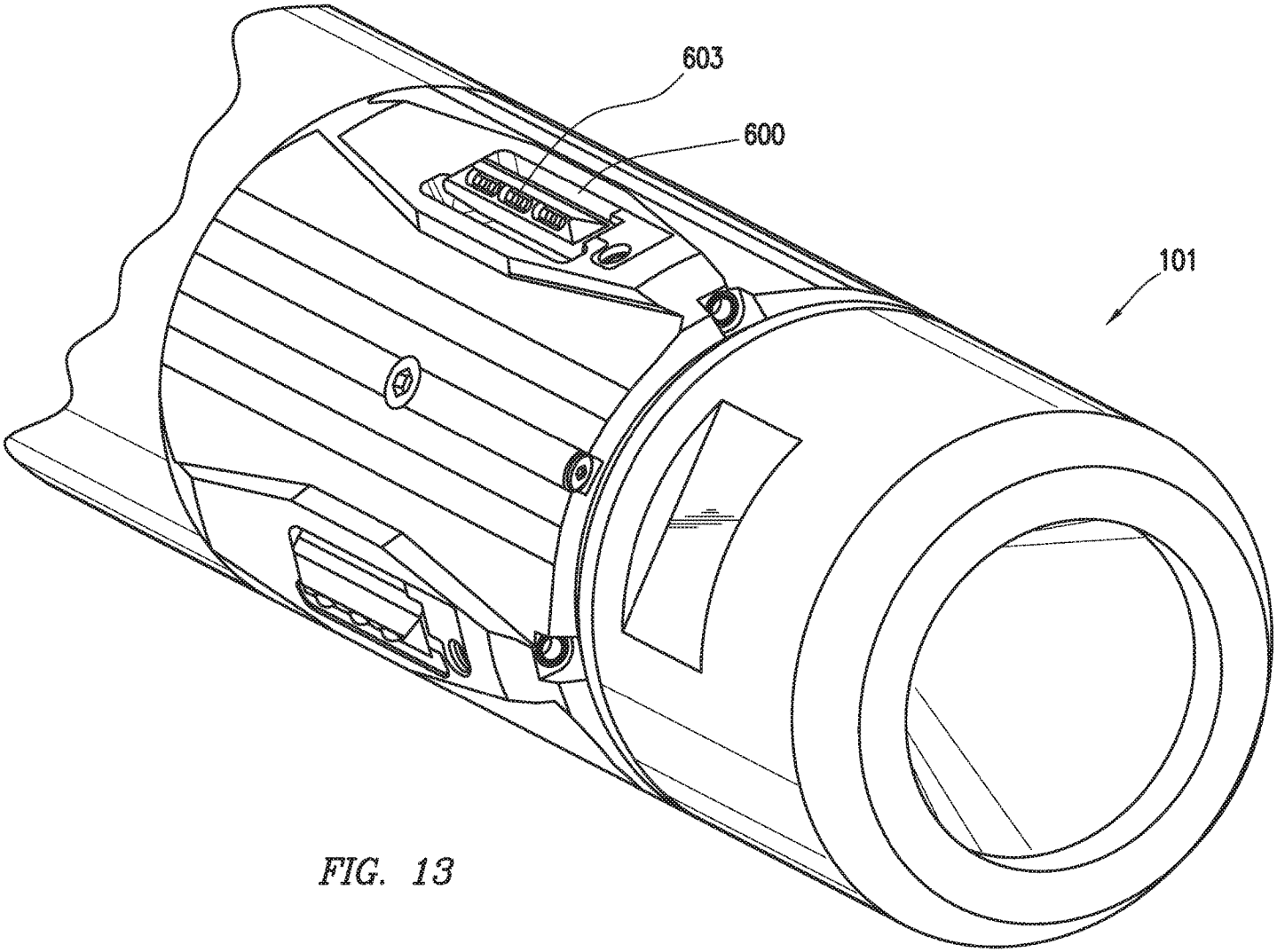
FIG. 13 depicts a perspective view of an antirotation stabilizer consistent with at least one embodiment of the present disclosure.
Figure 14:
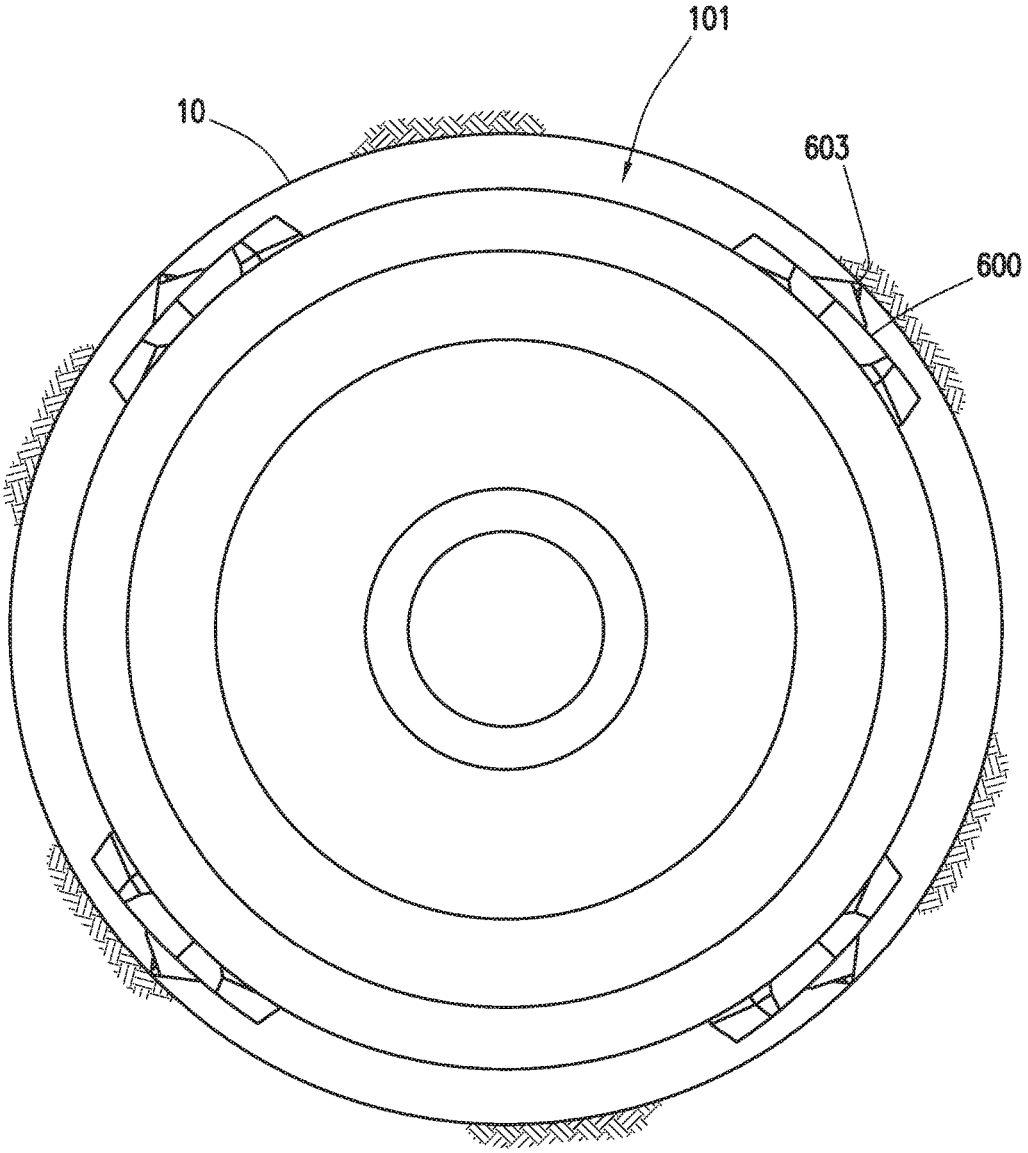
FIG. 14 depicts an end view of the antirotation stabilizer of FIG. 13.
Figure 15:
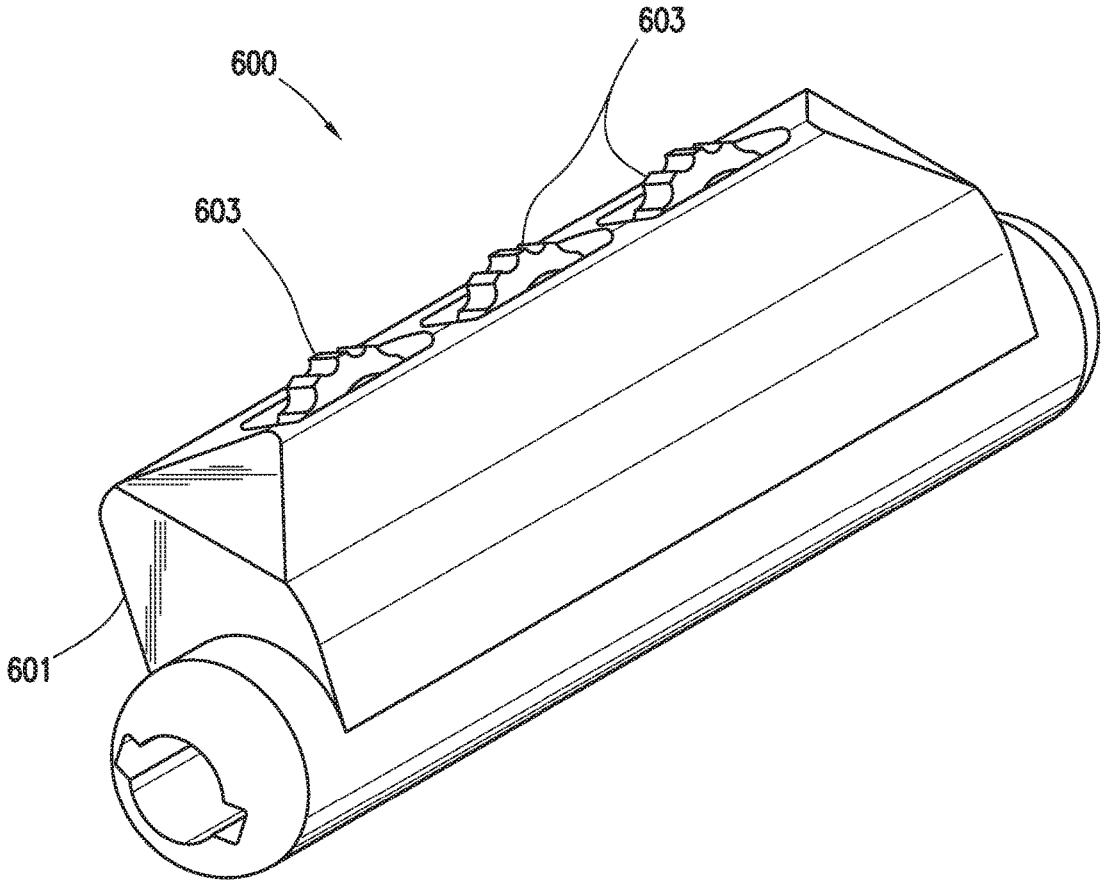
FIG. 15 depicts an antirotation pad of the antirotation stabilizer of FIG. 13.

In some embodiments, antirotation stabilizer 101 may include one or more rollers rather than inserts. For example, as depicted in FIGS. 13-15, antirotation pads 600 may include one or more rollers 603 rotatably coupled to pad bodies 601 adapted to contact the surrounding wellbore 10 and, as antirotation stabilizer 101 moves longitudinally, roll to reduce friction between antirotation pads 600 and wellbore 10 while maintaining contact therebetween.

Figure 16:
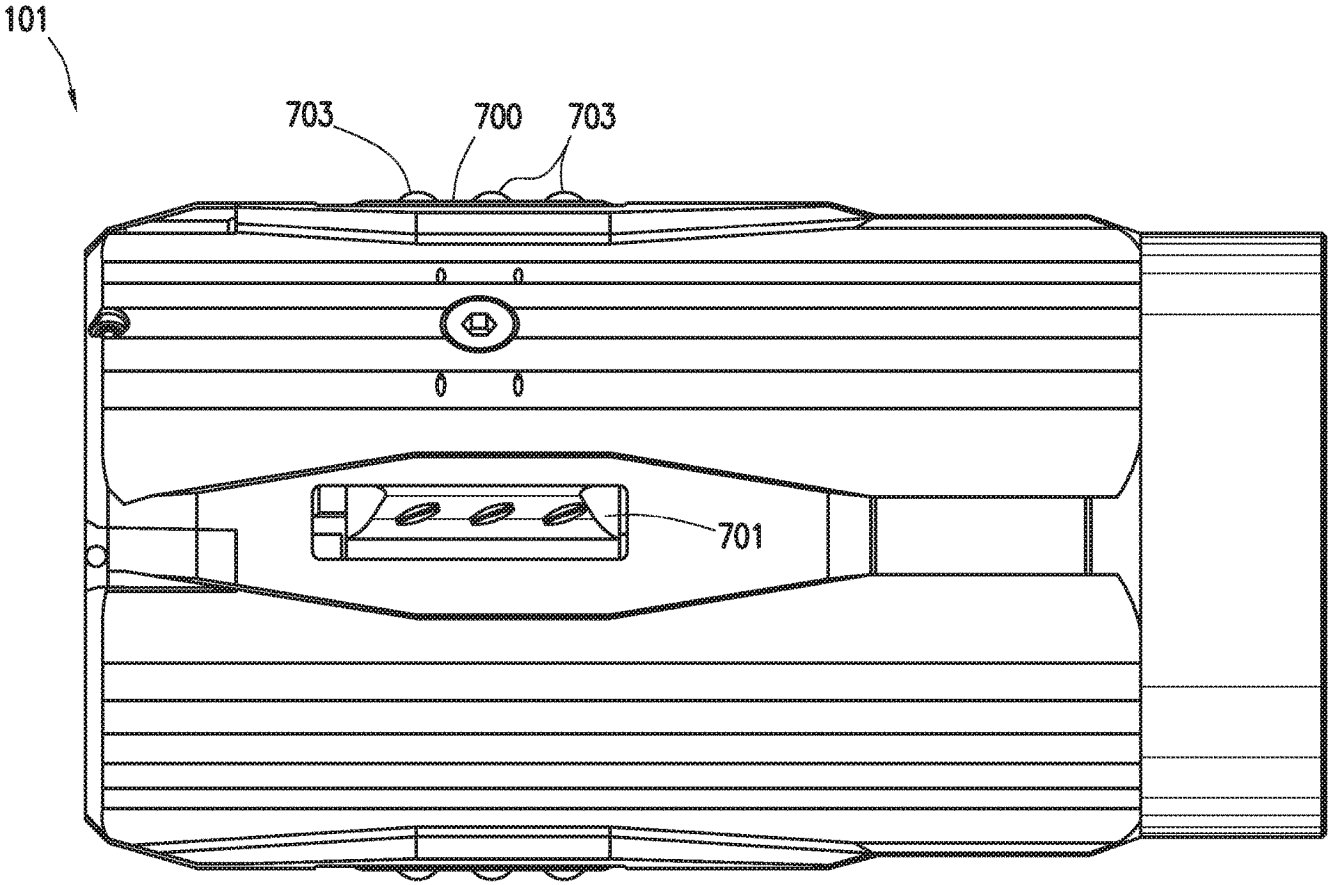
FIG. 16 depicts an elevation view of an antirotation stabilizer consistent with at least one embodiment of the present disclosure.
Figure 17:
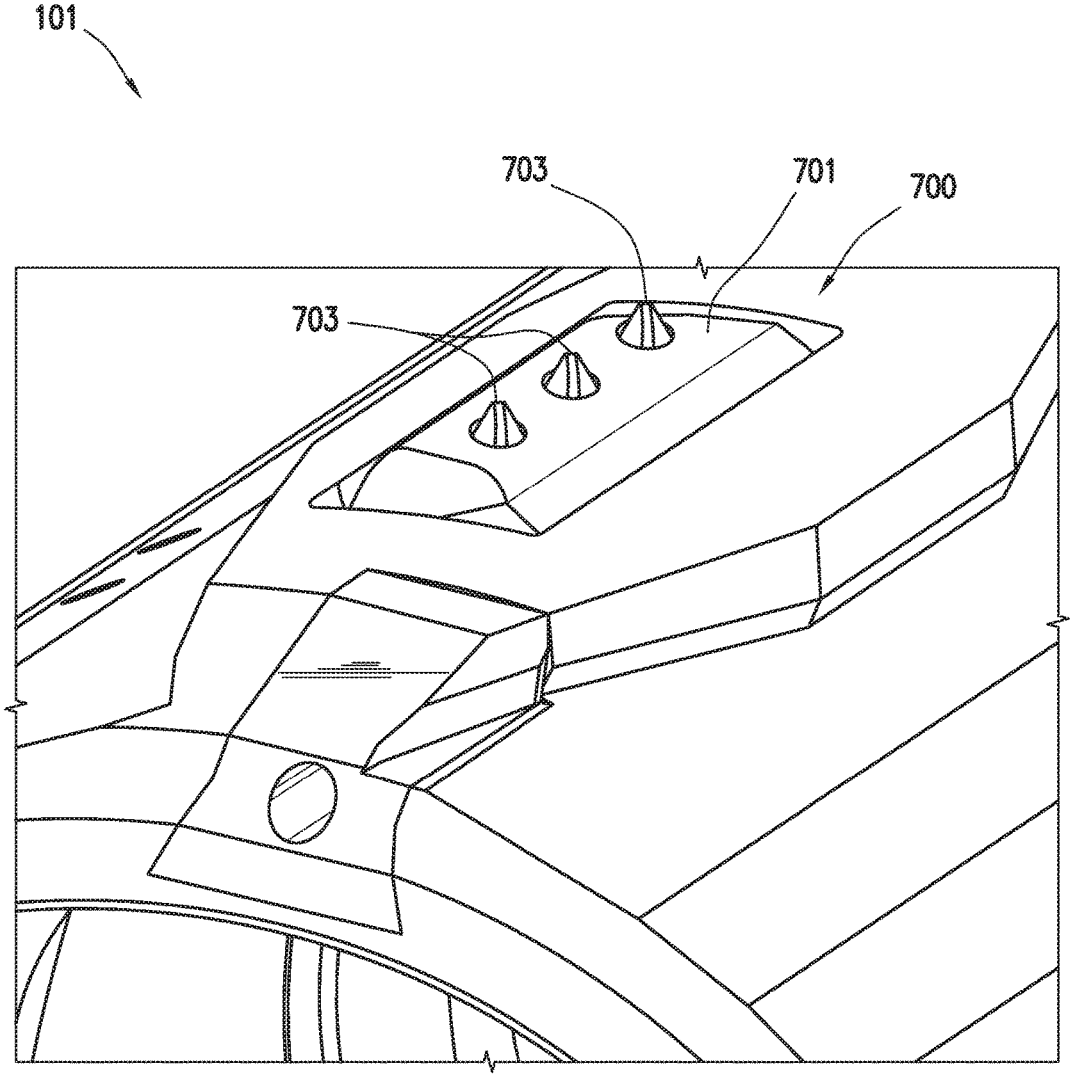
FIG. 17 depicts a detail perspective view of the antirotation stabilizer of FIG. 16.
Figure 18:
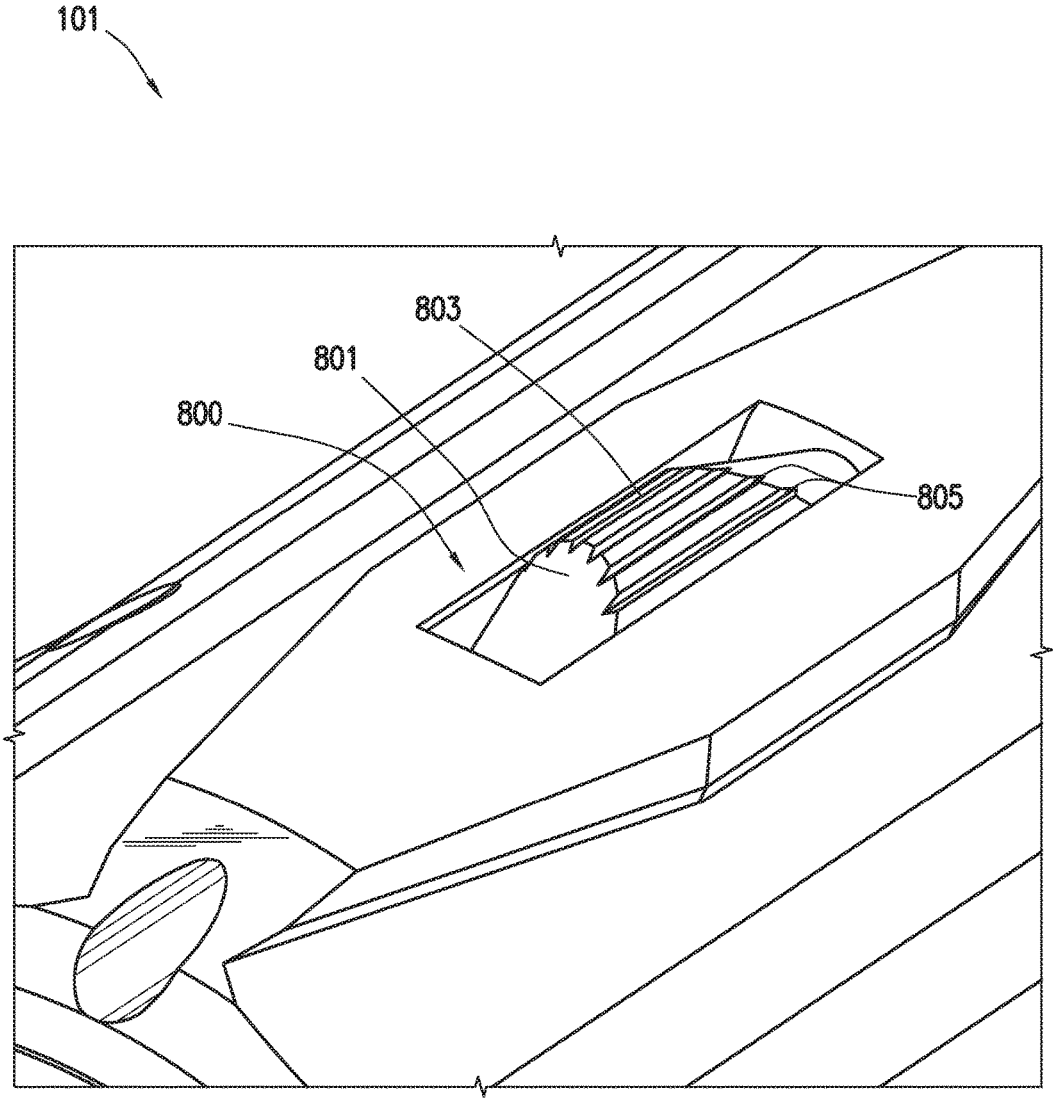
FIG. 18 depicts a perspective view of an antirotation stabilizer consistent with at least one embodiment of the present disclosure.
Figure 19:
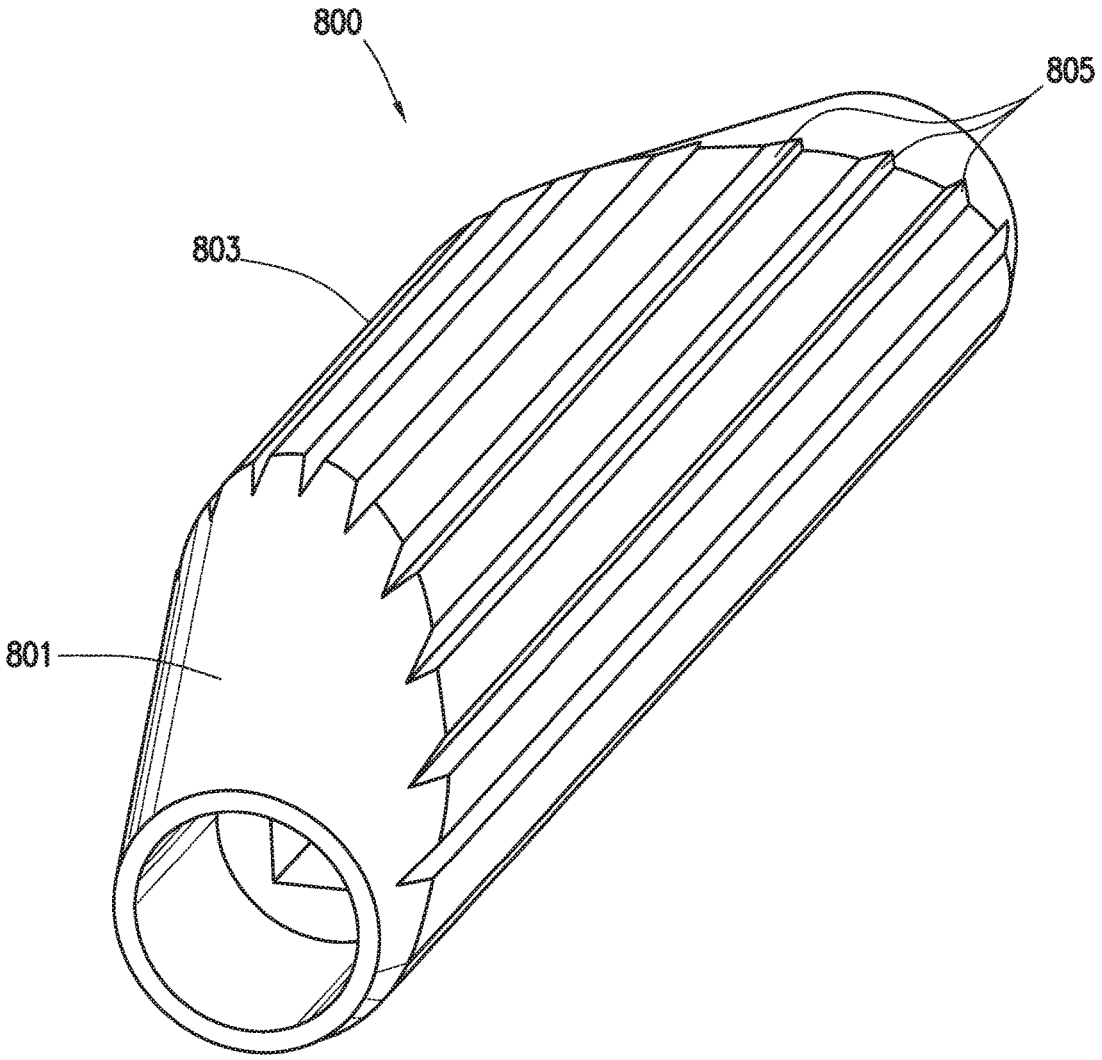
FIG. 19 depicts an antirotation pad of the antirotation stabilizer of FIG. 18.
Figure 20:
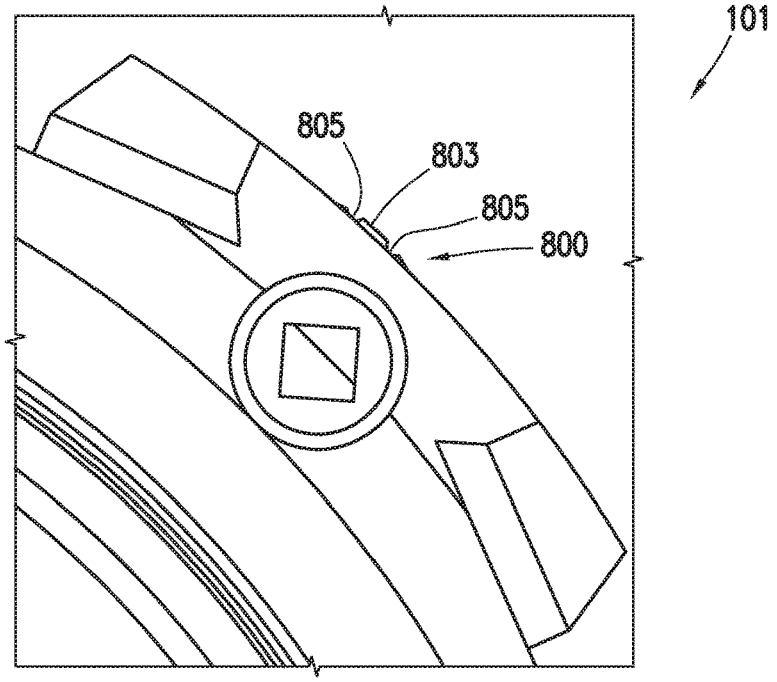
FIG. 20 depicts an end view of the antirotation stabilizer of FIG. 18 with antirotation pads in a retracted position.
Figure 21:
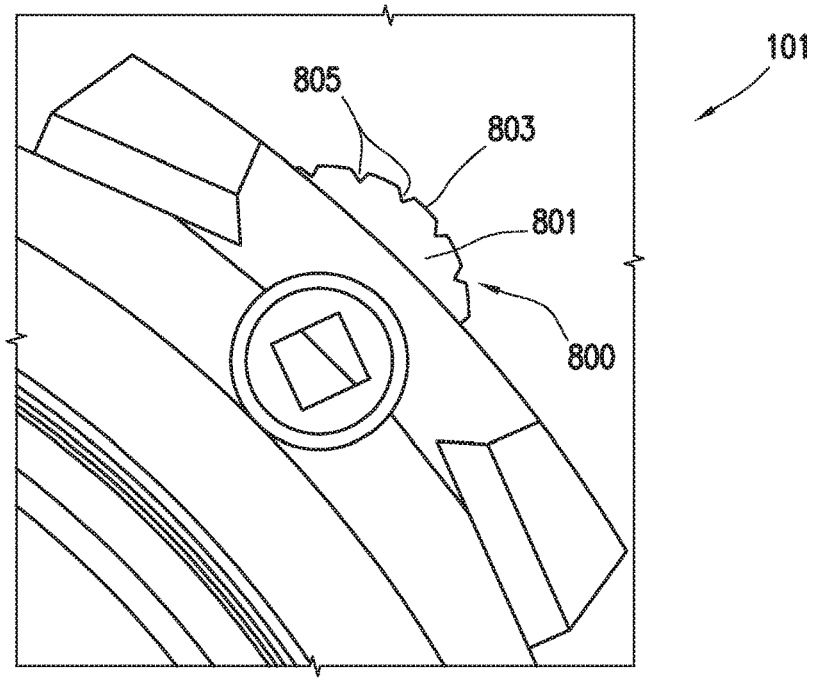
FIG. 21 depicts an end view of the antirotation stabilizer of FIG. 18 with antirotation pads in an extended position.

In some embodiments, as depicted in FIGS. 16, 17, antirotation stabilizer 101 may include antirotation pads 700 including one or more rollers 703 coupled to pad bodies 701 which are aligned at an angle to the longitudinal axis of antirotation stabilizer 101. In some such embodiments, rollers 703 may be aligned with a helix extending in the opposite direction of the rotation of the drilling shaft 103 discussed previously. In such an arrangement, rollers 703 may contact the surrounding wellbore 10 (not shown) and, as antirotation stabilizer 101 traverses wellbore 10, impart a torsional force on antirotation stabilizer 101 to, for example and without limitation, counteract incidental and unintentional rotation thereof during the drilling operation. In some embodiments, rollers 703 may be aligned at between a 0.1° and 45° angle, between a 0.5° and 20° angle, or between a 1° and 10° angle to the longitudinal axis of antirotation stabilizer 101.

In some embodiments, as depicted in FIGS. 18-21, antirotation stabilizer 101 may include antirotation pads 800 that do not include inserts or rollers. In some such embodiments, antirotation pads 800 may include convex contact surface 803 formed in pad body 801. Convex contact surface 803 may, for example and without limitation, cause further extension of antirotation pads 800 as increasing force is transferred between antirotation stabilizer 101 and surrounding wellbore 10 (not shown) as contact surface 803 rolls along surrounding wellbore 10. In some embodiments, antirotation pads 800 may include one or more surface features to increase the frictional force between antirotation pads 800 and the surrounding wellbore. In some embodiments, for example and without limitation, convex contact surface 803 of antirotation pads 800 may include one or more grooves 805 as shown in FIGS. 18-21.

Figure 22:
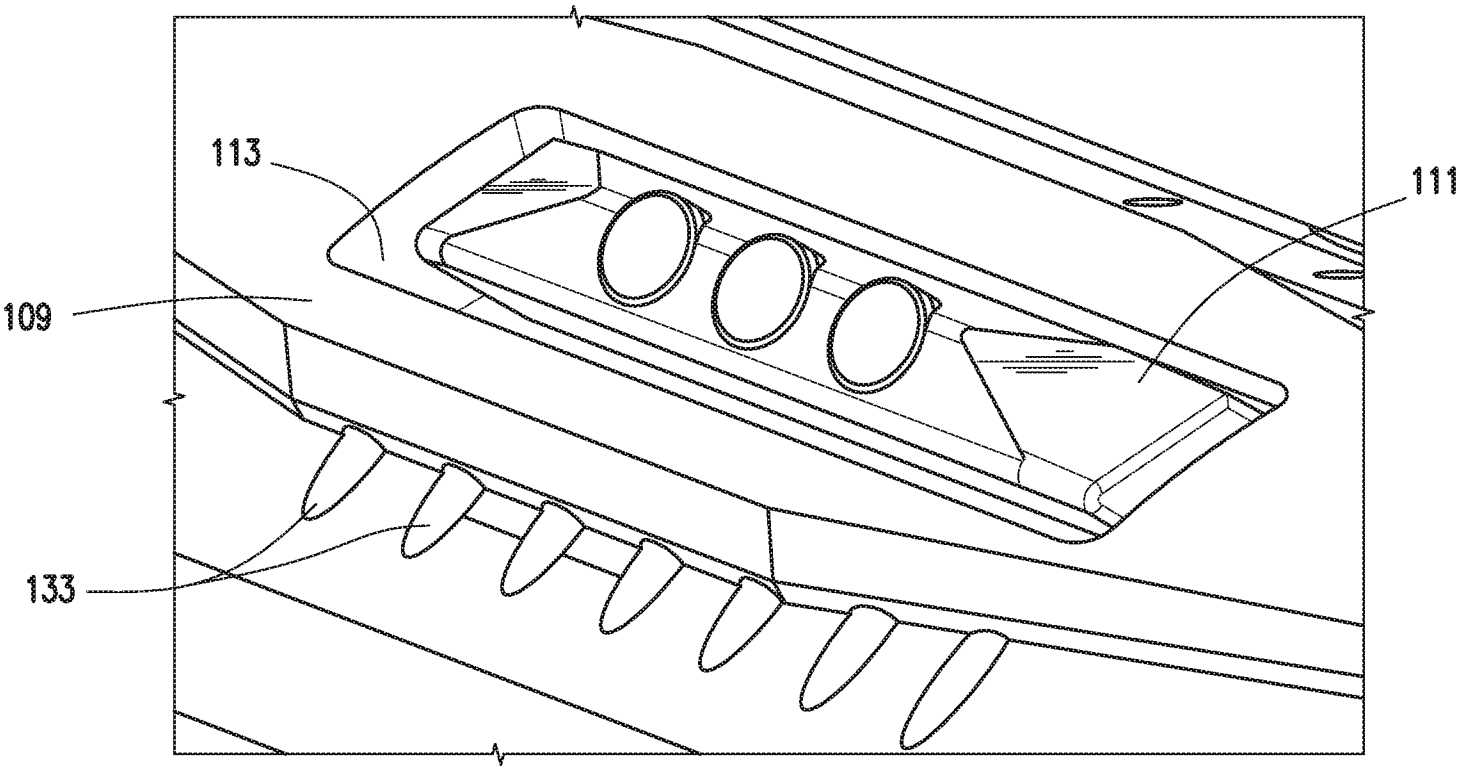
FIG. 22 depicts a detail perspective view of an antirotation stabilizer consistent with at least one embodiment of the present disclosure.

In some embodiments, as depicted in FIG. 22, one or more ports 133 may be formed in stabilizer body 109 between recess 113 and the exterior of stabilizer body 109. Ports 133 may, for example and without limitation, allow fluid or cuttings to exit recess 113 during drilling operations or as antirotation pad 111 retracts into recess 113 as previously discussed.

Figure 23:
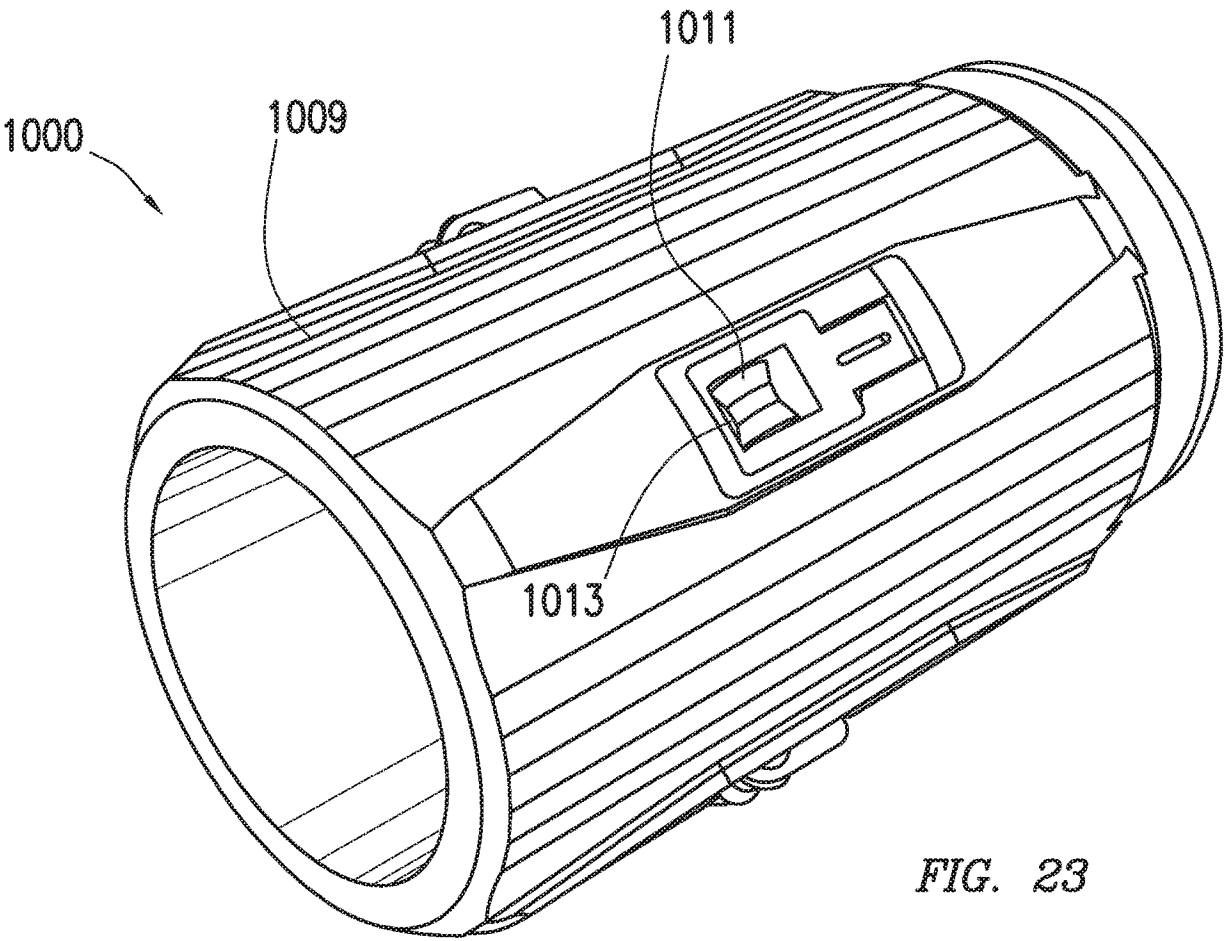
FIG. 23 depicts a perspective view of an antirotation stabilizer consistent with at least one embodiment of the present disclosure.

In some embodiments, as depicted in FIG. 23, antirotation stabilizer 1000 may include stabilizer body 1009 and antirotation roller 1011. Stabilizer body 1009 may include recess 1013 formed therein within which antirotation roller 1011 may be positioned. Antirotation roller 1011 may radially extend from the outer surface of stabilizer body 1009 to contact the surrounding wellbore 10 (not shown). Antirotation roller 1011 may engage wellbore 10 to prevent rotation of antirotation stabilizer 1000 while reducing friction therebetween as antirotation stabilizer 1000 moves longitudinally through wellbore 10.

Figure 24:
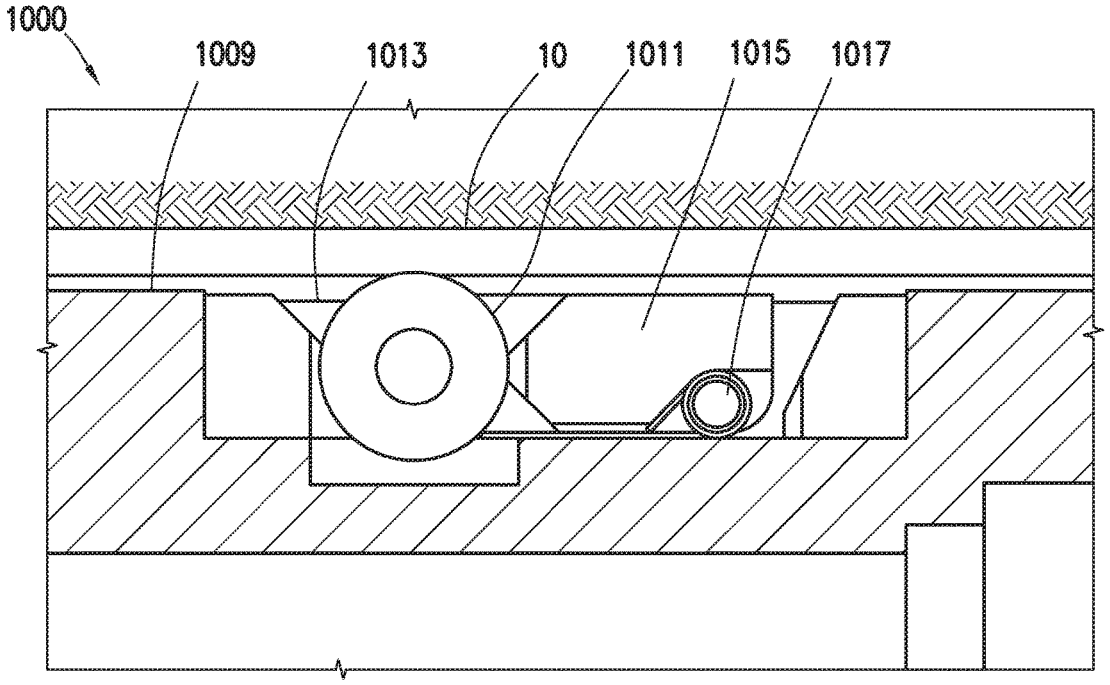
FIG. 24 depicts a cross section of an antirotation roller assembly of the antirotation stabilizer of FIG. 23.
Figure 25:
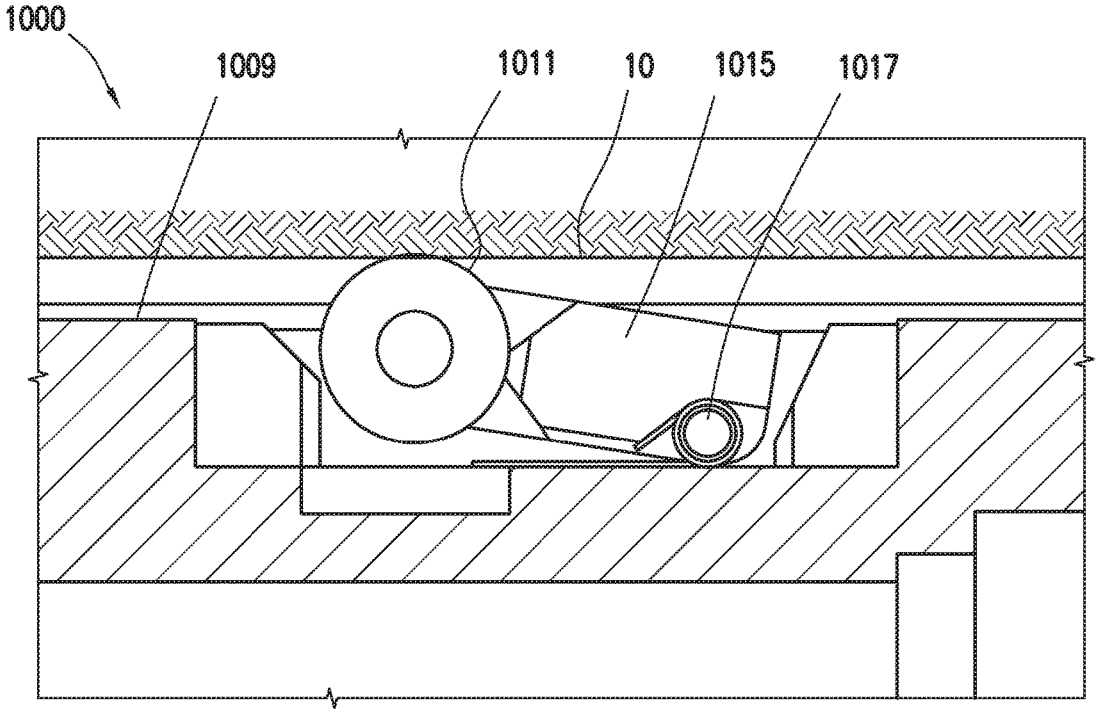
FIG. 25 depicts a cross section of the antirotation roller assembly of FIG. 24.

In some embodiments, as depicted in FIGS. 24, 25, antirotation roller 1011 may be hingedly coupled to stabilizer body 1009 by roller linkage 1015. In some embodiments, roller linkage 1015 may be biased into the extended position to engage antirotation roller 1011 against wellbore 10 (not shown) as depicted in FIG. 25. In some embodiments, roller linkage 1015 may be biased by a spring, such as spring 1017.

Figure 26:
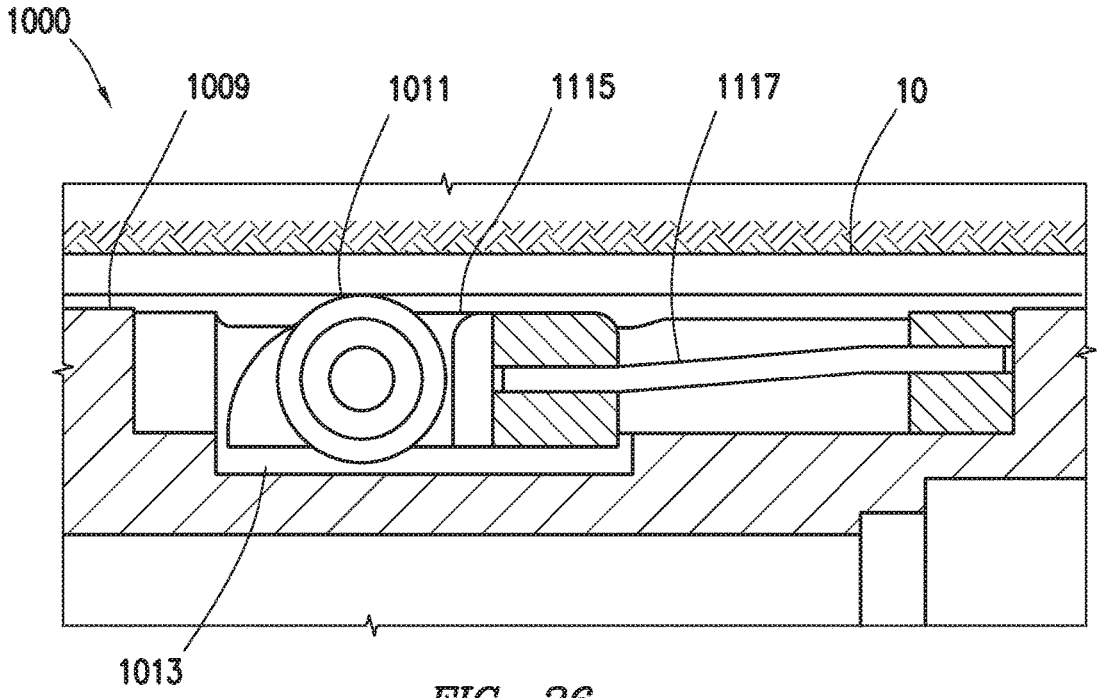
FIG. 26 depicts a cross section of an alternative antirotation roller assembly of the antirotation stabilizer of FIG. 23.
Figure 27:
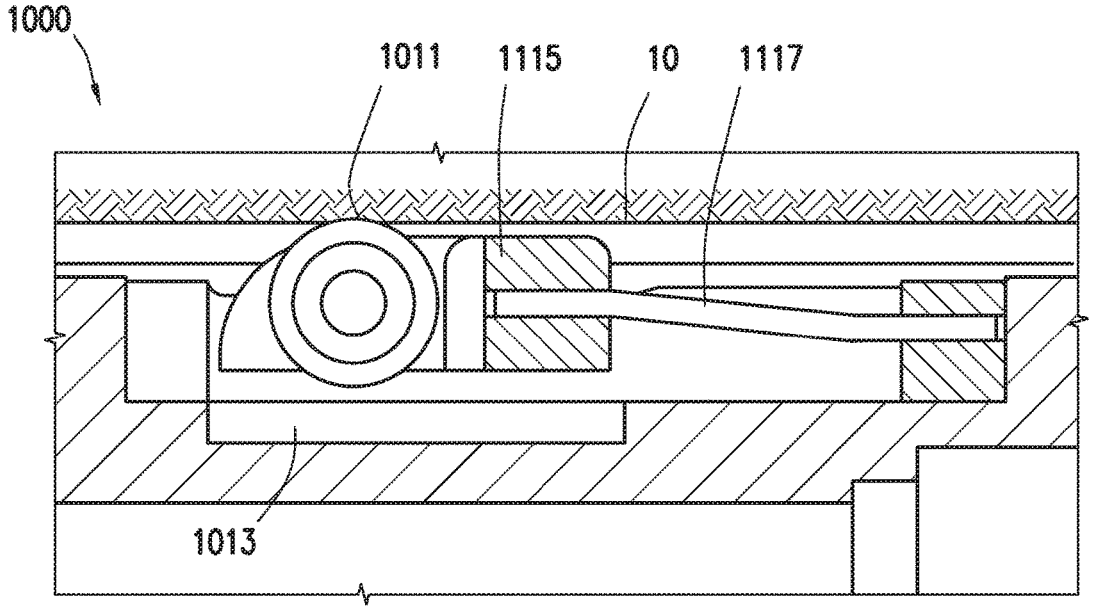
FIG. 27 depicts a cross section of the antirotation roller assembly of FIG. 26.

In some embodiments, as depicted in FIGS. 26, 27, antirotation roller 1011 may be rotatably coupled to carriage 1115. Carriage 1115 may be coupled to stabilizer body 1009 by carriage spring 1117. Carriage spring 1117 may, for example and without limitation, be a leaf spring as depicted.

In some embodiments, antirotation rollers 1011 as previously described may instead be biased by springs 1017, 1117 into an inward position (depicted in FIGS. 24, 26). Antirotation rollers 1011 may be selectively extended by one or more mechanisms. For example, in some embodiments, a roller coupled to stabilizer body 1009 such that it rotates in an axis perpendicular to the longitudinal axis of antirotation stabilizer 1000 may be in contact with wellbore 10 such rotation of antirotation stabilizer 1000 causes rotation of the roller, causing extension of antirotation rollers 1011.

Figure 28:
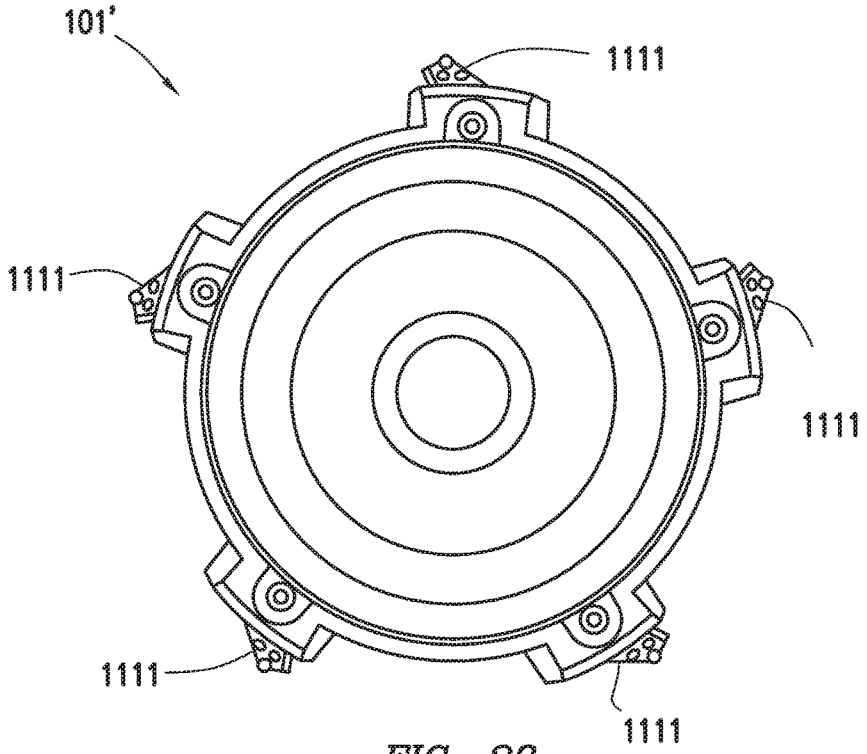
FIG. 28 depicts an end view of an antirotation stabilizer consistent with at least one embodiment of the present disclosure.

Although depicted herein as including four antirotation pads 111, one having ordinary skill in the art with the benefit of this disclosure will understand that antirotation stabilizer 101, 1000 as described herein above may utilize any number of antirotation pads 111 or antirotation rollers 1011 without deviating from the scope of this disclosure. For example, in some embodiments, antirotation stabilizer 101 may include one or more antirotation pads 111. In some embodiments, antirotation stabilizer 101 may include three or more antirotation pads 111. For example, FIG. 28 depicts antirotation stabilizer 101' including five antirotation pads 1111.

Figure 29:
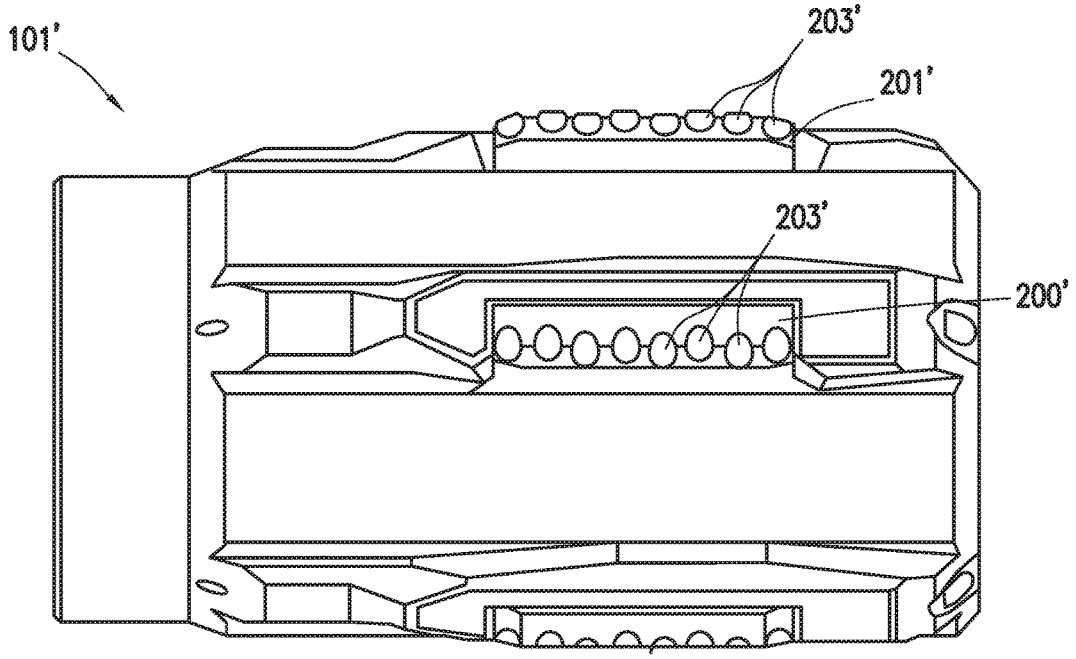
FIG. 29 depicts a side view of an antirotation stabilizer consistent with at least one embodiment of the present disclosure.

Additionally, one having ordinary skill in the art with the benefit of this disclosure will understand that, with reference to FIG. 29, inserts 203' of antirotation pads 200' may be positioned in any configuration without deviating from the scope of this disclosure. The arrangements depicted herein are exemplary of those used in certain embodiments of the present disclosure. For example and without limitation, inserts 203' in FIG. 29 are arranged staggered within antirotation pads 200'.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. An antirotation stabilizer positionable in a wellbore comprising: a stabilizer body having a recess formed therein; an antirotation pad positioned at least partially within the recess wherein the antirotation pad cams out of recess; and a torsion bar, the torsion bar coupled between the stabilizer body and the antirotation pad, the torsion bar coupled to the antirotation pad off center of the antirotation pad, the torsion bar being in torsional loading.

2. The antirotation stabilizer of claim 1, wherein the antirotation pad includes at least one pad slot and the torsion bar includes a corresponding tab.

3. The antirotation stabilizer of claim 1, wherein the torsion bar is rectangular in cross section, and the antirotation pad includes a corresponding rectangular hole.

4. The antirotation stabilizer of claim 1, wherein the antirotation pad includes a pad body, the pad body including a contact surface.

5. The antirotation stabilizer of claim 4, wherein the contact surface is convex.

6. The antirotation stabilizer of claim 4, wherein the contact surface includes one or more grooves.

7. The antirotation stabilizer of claim 1, wherein the antirotation pad further comprises an insert.

8. The antirotation stabilizer of claim 7, wherein the insert is one of tungsten carbide or polycrystalline diamond.

9. The antirotation stabilizer of claim 7, wherein the insert is triangular in cross section.

10. The antirotation stabilizer of claim 7, wherein the antirotation pad further comprises two or more inserts.

11. The antirotation stabilizer of claim 10, wherein the inserts are aligned in parallel with a longitudinal axis of the antirotation stabilizer.

12. The antirotation stabilizer of claim 10, wherein the inserts are aligned along a helix extending along a longitudinal axis of the antirotation stabilizer.

13. The antirotation stabilizer of claim 1, wherein the antirotation pad further comprises a roller.

14. The antirotation stabilizer of claim 13, wherein the roller is aligned with a longitudinal axis of the antirotation stabilizer.

15. The antirotation stabilizer of claim 13, wherein the roller is aligned at an angle to a longitudinal axis of the antirotation stabilizer.

16. The antirotation stabilizer of claim 1, further comprising at least one port extending through the stabilizer body between the recess and an outer surface of the stabilizer body.

17. The antirotation stabilizer of claim 1, wherein the antirotation stabilizer is positionable in an uncased wellbore.

18. A method comprising: providing an antirotation stabilizer including: a stabilizer body having a recess formed therein; an antirotation pad positioned at least partially within the recess; and a torsion bar, the torsion bar coupled between the stabilizer body and the antirotation pad, the torsion bar coupled to the antirotation pad off center of the antirotation pad, the torsion bar being in torsional loading; positioning the antirotation stabilizer in an uncased portion of a wellbore; camming the antirotation pad from the stabilizer body under torsion from the torsion bar; engaging the wellbore with the antirotation pad; and preventing rotation of the antirotation stabilizer relative to the wellbore.

* * * * *